US012285147B2

(12) United States Patent
Zhu et al.

(10) Patent No.: US 12,285,147 B2
(45) Date of Patent: Apr. 29, 2025

(54) ADJUSTMENT DEVICE, AIR DUCT STRUCTURE, EXHAUST SYSTEM, DISHWASHER, AND METHOD FOR CONTROLLING DISHWASHER

(71) Applicant: FOSHAN SHUNDE MIDEA WASHING APPLIANCES MANUFACTURING CO., LTD., Guangdong (CN)

(72) Inventors: Xiqing Zhu, Guangdong (CN); Jie Geng, Guangdong (CN); Xiang Li, Guangdong (CN)

(73) Assignee: FOSHAN SHUNDE MIDEA WASHING APPLIANCES MANUFACTURING CO., LTD., Guangdong (CN)

( * ) Notice: Subject to any disclaimer, the term of this patent is extended or adjusted under 35 U.S.C. 154(b) by 0 days.

(21) Appl. No.: 18/516,133

(22) Filed: Nov. 21, 2023

(65) Prior Publication Data

US 2024/0081609 A1 Mar. 14, 2024

Related U.S. Application Data

(63) Continuation of application No. PCT/CN2022/078390, filed on Feb. 28, 2022.

(30) Foreign Application Priority Data

Jul. 2, 2021 (CN) ..... 202110755196.5
Jul. 2, 2021 (CN) ..... 202121508635.4
(Continued)

(51) Int. Cl.
*A47L 15/48* (2006.01)
*A47L 15/00* (2006.01)
(Continued)

(52) U.S. Cl.
CPC ..... *A47L 15/488* (2013.01); *A47L 15/0028* (2013.01); *A47L 15/0031* (2013.01);
(Continued)

(58) Field of Classification Search
CPC ..... A47L 15/488; A47L 15/0028; A47L 15/0031; A47L 15/4285; A47L 15/4287;
(Continued)

(56) References Cited

U.S. PATENT DOCUMENTS 9,510,728 B2 * 12/2016 Tuller ..... A47L 15/488
10,506,912 B2 * 12/2019 Kopera ..... A47L 15/486
(Continued)

FOREIGN PATENT DOCUMENTS

CA 2569288 C * 8/2011 ..... A47L 15/4217
CN 204618152 U 9/2015
(Continued)

OTHER PUBLICATIONS

KR 101308832 (Year: 2013).*
(Continued)

*Primary Examiner* — Alexander Markoff
(74) *Attorney, Agent, or Firm* — Scully, Scott, Murphy & Presser, P.C.

(57) ABSTRACT

An adjustment device, an air duct structure, an exhaust system, a dishwasher, and a method for controlling the dishwasher are provided. The adjustment device is applied in an exhaust system. The exhaust system has an exhaust channel with a second air inlet and a first air inlet. The adjustment device includes an adjustment mechanism and a controller. The adjustment mechanism is configured to, under control of the controller, respectively adjust a flow rate of a first gas entering the exhaust channel through the first air inlet and a flow rate of a second gas entering the exhaust channel through the second air inlet, to control a ratio of the
(Continued)

first gas entering the exhaust channel to the second gas entering the exhaust channel. Humidity of the second gas is lower than humidity of the first gas.

22 Claims, 11 Drawing Sheets

(30) Foreign Application Priority Data

Jul. 2, 2021 (CN) ..... 202121508646.2
Jul. 2, 2021 (CN) ..... 202121509035.X

(51) Int. Cl.
*A47L 15/42* (2006.01)
*A47L 15/46* (2006.01)

(52) U.S. Cl.
CPC ..... *A47L 15/4285* (2013.01); *A47L 15/4287* (2013.01); *A47L 15/46* (2013.01); *A47L 15/486* (2013.01); *A47L 2401/19* (2013.01)

(58) Field of Classification Search
CPC .... A47L 15/46; A47L 15/486; A47L 2401/19; A47L 15/48; A47L 2401/18; A47L 2501/10; A47L 15/4274; A47L 2501/12
See application file for complete search history.

(56) References Cited

U.S. PATENT DOCUMENTS

| | | | | |
|---|---|---|---|---|
| 11,259,684 | B2 * | 3/2022 | Delellis | A47L 15/486 |
| 2007/0102026 | A1 * | 5/2007 | Ahn | A47L 15/0049 134/94.1 |
| 2007/0251552 | A1 * | 11/2007 | Lee | A47L 15/481 134/56 D |
| 2008/0087307 | A1 * | 4/2008 | Han | A47L 15/486 134/104.4 |
| 2009/0095330 | A1 | 4/2009 | Iwanaga et al. | |
| 2011/0126864 | A1 * | 6/2011 | Kim | A47L 15/483 134/115 R |
| 2016/0143507 | A1 * | 5/2016 | Tuller | A47L 15/486 134/107 |
| 2019/0216289 | A1 * | 7/2019 | Vallejo | B01D 53/265 |

FOREIGN PATENT DOCUMENTS

| | | | | |
|---|---|---|---|---|
| CN | 109846439 | A | 6/2019 | |
| CN | 209346960 | U | 9/2019 | |
| CN | 215838911 | U | 2/2022 | |
| CN | 215838912 | U | 2/2022 | |
| EP | 0920830 | A1 | 6/1999 | |
| EP | 1127532 | A2 * | 8/2001 | A47L 15/488 |
| JP | S5559223 | U | 4/1980 | |
| JP | S5979662 | U | 5/1984 | |
| JP | S60185550 | U | 12/1985 | |
| JP | H07184822 | A | 7/1995 | |
| JP | 2002304875 | A | 10/2002 | |
| JP | 2009178231 | A | 8/2009 | |
| KR | 20020047870 | A | 6/2002 | |

OTHER PUBLICATIONS

EP 1230891 (Year: 2002).*
EP 0521815 (Year: 1993).*
JP 2007-54222 (Year: 2007).*
DE 102021201764 (Year: 2021).*
KR 1020060124297 (Year: 2006).*
International Search Report dated May 24, 2022 issued in PCT/CN2022/078390.
Extended European search report dated Sep. 9, 2024 received in European Patent Application No. 22831200.5.
Notification of Reasons for Refusal dated Oct. 29, 2024 received in Japanese Patent Application No. 2023-574286.

* cited by examiner

ADJUSTMENT DEVICE, AIR DUCT STRUCTURE, EXHAUST SYSTEM, DISHWASHER, AND METHOD FOR CONTROLLING DISHWASHER

CROSS-REFERENCES TO RELATED APPLICATIONS

This application is a continuation application of PCT International Application No. PCT/CN2022/078390, filed on Feb. 28, 2022, which claims priorities to Chinese Patent Applications No. 202110755196.5, No. 202121508646.2, No. 202121509035.X, and No. 202121508635.4, filed on Jul. 2, 2021 and entitled "ADJUSTMENT DEVICE, AIR DUCT STRUCTURE, EXHAUST SYSTEM, DISHWASHER, AND METHOD FOR CONTROLLING DISHWASHER", the entire disclosures of each of which are incorporated herein by reference. No new matter has been introduced.

FIELD

The present disclosure relates to the technical field of exhaust control of a dishwasher, and more particularly, to an adjustment device, an air duct structure, an exhaust system, a dishwasher, and a method for controlling the dishwasher.

BACKGROUND

With the continuous improvement of living standards, users have higher and higher requirements for usage performance of a household dishwasher. The usage performance includes drying performance. However, currently on the market, although various drying methods are applied in the dishwasher, these drying methods have disadvantage such as easy generation of condensate water when drying efficiency is improved.

SUMMARY

Embodiments of the present disclosure are to provide an adjustment device, an air duct structure, an exhaust system, a dishwasher, and a method for controlling the dishwasher. The present disclosure aims to solve a problem that a traditional dishwasher is unable to reduce condensate water generation while enhancing drying efficiency.

In view of the above, an embodiment of the present disclosure provides an adjustment device applied in an exhaust system of a dishwasher. The exhaust system has an exhaust channel with a first air inlet in communication with a tub of the dishwasher and a second air inlet and. The adjustment device includes an adjustment mechanism and a controller. The adjustment mechanism is configured to, under control of the controller, respectively adjust a flow rate of a first gas entering the exhaust channel through the first air inlet and a flow rate of a second gas entering the exhaust channel through the second air inlet, to control a ratio of the first gas entering the exhaust channel to the second gas entering the exhaust channel. Humidity of the second gas is lower than humidity of the first gas.

According to some embodiments of the present disclosure, the first air inlet is a steam inlet. The second air inlet is an air inlet. The first gas is steam. The second gas is air.

In some embodiments of the present disclosure, the adjustment mechanism includes an adjustment member and a drive component. The adjustment member is movably arranged between the air inlet and the steam inlet. The drive component is configured to drive the adjustment member to move between the air inlet and the steam inlet, to adjust a flow rate of steam entering the exhaust channel through the steam inlet and/or a flow rate of air entering the exhaust channel through the air inlet. The controller is electrically connected to the drive component, and is configured to control a position of the adjustment member between the air inlet and the steam inlet to control a ratio of the steam entering the exhaust channel to the air entering the exhaust channel.

In some embodiments of the present disclosure, the drive component includes a driver and a transmission mechanism connecting the driver and the adjustment member.

In some embodiments of the present disclosure, the adjustment member is constructed in a plate-like shape, and is configured for, driven by the drive component, reciprocating rotation between the steam inlet and the air inlet.

In some embodiments of the present disclosure, the adjustment member includes a plate-shaped body and a mounting disc portion. The plate-shaped body is movably arranged between the steam inlet and the air inlet. The mounting disc portion is disposed at an end of the plate-shaped body. The mounting disc portion is rotatably connected to a side wall of the exhaust channel, and the drive component is connected to the mounting disc portion.

In some embodiments of the present disclosure, the drive component includes a drive motor and two rotary portions. The two rotary portions are arranged in parallel to each other and rotatably connected to the exhaust channel. The two rotary portions are connected to the drive motor and the adjustment member in one-to-one correspondence. The two rotary portions are provided with teeth at least on sides of the two rotary portions facing towards each other, and the teeth are engaged with each other.

In some embodiments of the present disclosure, the adjustment member includes a plate-shaped body and a mounting disc portion. The plate-shaped body is movably arranged between the steam inlet and the air inlet. The mounting disc portion is disposed at an end of the plate-shaped body. The mounting disc portion is rotatably connected to a side wall of the exhaust channel. The adjustment member is connected to a rotary portion coaxially mounted at the mounting disc portion and is restricted between the mounting disc portion and the side wall of the exhaust channel.

In some embodiments of the present disclosure, the mounting disc portion is at least partially hollowed-out.

In some embodiments of the present disclosure, the adjustment member has an abutment side facing towards the steam inlet, and is provided with an elastic seal layer and/or a protrusion at the abutment side, and the protrusion is engaged with and fixed to the steam inlet; and/or the adjustment member has an abutment side facing towards the air inlet, and is provided with an elastic seal layer and/or a protrusion at the abutment side, and the protrusion is engaged with and fixed to the air inlet.

In some embodiments of the present disclosure, the adjustment device further includes a limit structure configured to limit the adjustment member at a housing of the exhaust channel when the adjustment member moves to cover the steam inlet and/or when the adjustment member moves to cover the air inlet.

In some embodiments of the present disclosure, the drive component includes a drive motor and two rotary portions arranged in parallel to each other and rotatably connected to the exhaust channel. The two rotary portions are connected to the drive motor and the adjustment member in one-to-one correspondence. The two rotary portions are provided with teeth at least on sides of the two rotary portions facing towards each other, and the teeth are engaged with each other. The limit structure is constructed by the teeth of the two rotary portions.

In some embodiments of the present disclosure, the adjustment member is provided with a guide portion. The guide portion is movably connected to an engagement portion disposed at the exhaust channel, to guide the adjustment member to move between the steam inlet and the air inlet.

In some embodiments of the present disclosure, the guide portion is constructed as a slid protrusion slidably connected to the engagement portion constructed as a slid groove.

In some embodiments of the present disclosure, the adjustment device further includes a position sensor electrically connected to the controller to sense position information on the adjustment member and/or a sensor electrically connected to the controller. The sensor includes a temperature sensing module and a humidity sensing module, and is configured to sense a temperature and humidity at the exhaust channel.

In addition, in order to achieve the above objects, according to a second aspect of the present disclosure, an exhaust system is further provided. The exhaust system includes a housing and the adjustment device according to the above first aspect. The housing has an exhaust channel, and a steam inlet and an air inlet that are in communication with the exhaust channel. The steam inlet is in communication with a tub of a dishwasher, and the air inlet is configured to introduce external air.

In addition, in order to achieve the above objects, according to a third aspect of the present disclosure, a dishwasher is further provided. The dishwasher includes a shell, a tub disposed in the shell, and the exhaust system according to the above second aspect. The exhaust system is mounted at the shell.

In addition, in order to achieve the above objects, according to a fourth aspect of the present disclosure, provided is an air duct structure applied in an exhaust system of a dishwasher. The air duct structure further includes the adjustment device according to the above first aspect. The air duct structure includes a housing with the exhaust channel. The exhaust channel includes a mixing channel section and an air outlet channel section that are in sequential communication with each other. The mixing channel section has the steam inlet and the air inlet configured to introduce external air. The mixing channel section is configured for mounting of the adjustment device, to allow the adjustment device to adjust a flow rate of steam entering the exhaust channel through the steam inlet and/or a flow rate of air entering the exhaust channel through the air inlet, to control a ratio of the steam entering the exhaust channel to the air entering the exhaust channel.

In some embodiments of the present disclosure, the housing includes a first cavity casing having the steam inlet and a second cavity casing having the air inlet. The first cavity casing is connected to the second cavity casing in a bending manner to define the mixing channel section between the first cavity casing and the second cavity casing.

In some embodiments of the present disclosure, an angle is formed between a side of the first cavity casing facing towards the mixing channel section and a side of the second cavity casing facing towards the mixing channel section. The angle is smaller than 180°.

In some embodiments of the present disclosure, an outer wall of the housing is recessed inwards to form a bump in the exhaust channel. An outer side of the bump is configured to cover an air outlet of a tub. The steam inlet is formed at a side wall of the bump.

In some embodiments of the present disclosure, the side wall of the bump is at least partially formed into an arc shape.

In some embodiments of the present disclosure, the housing includes a first housing and a second housing. The mixing channel section is formed at the first housing. The air outlet channel section is at least partially formed at the second housing, and the first housing is detachably connected to the second housing.

In some embodiments of the present disclosure, an end of the first housing is nested to an end of the second housing at a nesting position, and at the nesting between the first housing and the second housing, the first housing is provided with a connector, and the second housing is provided with a mating connector connected to the connector.

In some embodiments of the present disclosure, a connection between the mixing channel section and the air outlet channel section is at least partially in an arc transition.

In addition, in order to achieve the above objects, according to a fifth aspect of the present disclosure, an exhaust system is further provided. The exhaust system includes the air duct structure according to the above fourth aspect, and the adjustment device mounted in the mixing channel section to adjust a flow rate of steam entering the exhaust channel through a steam inlet and/or a flow rate of air entering the exhaust channel through the air inlet, to control a ratio of the steam entering the exhaust channel to the air entering the exhaust channel.

In some embodiments of the present disclosure, the adjustment device includes an adjustment member and a drive component configured to drive the adjustment member to move between the steam inlet and the air inlet.

In some embodiments of the present disclosure, the adjustment member has a mounting end and a free end opposite to the mounting end. The mounting end is rotatably connected between the steam inlet and the air inlet, and the free end faces towards and is located close to a communication between the mixing channel section and the air outlet channel section.

In addition, in order to achieve the above objects, according to a sixth aspect of the present disclosure, a dishwasher is further provided. The dishwasher includes a shell, a tub disposed in the shell, and the exhaust system according to the above fifth aspect. The exhaust system is mounted at the shell.

In addition, in order to achieve the above objects, according to a seventh aspect of the present disclosure, an exhaust system is provided. The exhaust system includes a housing and the adjustment device according to the first aspect. The housing has an exhaust channel, and a first air inlet and a second air inlet that are in communication with the exhaust channel. The first air inlet is configured to introduce a first gas discharged from the tub, and the second air inlet is configured to introduce a second gas with humidity lower than humidity of the first gas.

In some embodiments of the present disclosure, the adjustment mechanism includes an adjustment member and a drive component. The adjustment member is movably arranged between the first air inlet and the second air inlet. The adjustment member is configured to, when driven by the drive component, move towards the first air inlet to cover the first air inlet and to move towards the second air inlet to cover the second air inlet.

In some embodiments of the present disclosure, the exhaust channel has a connection wall located between the first air inlet and the second air inlet. The adjustment member is translatably arranged at the connection wall. The adjustment member is configured to, when driven by the drive component, translate towards the first air inlet to cover the first air inlet and translate towards the second air inlet to cover the second air inlet.

In some embodiments of the present disclosure, the exhaust channel has a connection wall located between the first air inlet and the second air inlet; and the adjustment member has a mounting end rotatably mounted at the connection wall. The adjustment member is configured to, when driven by the drive component, rotate towards the first air inlet to cover the first air inlet and rotate towards the second air inlet to cover the second air inlet.

In some embodiments of the present disclosure, the drive component includes: a drive motor electrically connected to the controller, and two rotary portions mounted rotatably at the exhaust channel in parallel to each other. One of the two rotary portions is connected to the drive motor, and another one of the two rotary portions is connected to the mounting end. The two rotary portions are provided with teeth at least on sides of the two rotary portions facing towards each other, and the teeth are engaged with each other.

In some embodiments of the present disclosure, the exhaust system further includes a connection structure disposed at the adjustment member and/or the housing. The connection structure is configured to connect the adjustment member and the housing when the adjustment member moves to cover the first air inlet; and/or the connection structure is configured to connect the adjustment member and the housing when the adjustment member moves to cover the second air inlet.

In some embodiments of the present disclosure, the adjustment member is constructed in a plate-like shape, and has an abutment side facing towards the first air inlet and/or an abutment side facing towards the second air inlet. The adjustment member is provided with an elastic seal layer at least at the abutment side.

In some embodiments of the present disclosure, the adjustment member has a protrusion provided in a middle of the abutment side. The protrusion is configured to be caught into the first air inlet when the adjustment member moves to cover the first air inlet, and/or caught into the second air inlet when the adjustment member moves to cover the second air inlet.

In some embodiments of the present disclosure, the exhaust system further includes a position sensor electrically connected to the controller and configured to transmit a sensing signal to the controller when the adjustment member moves to cover the first air inlet.

In some embodiments of the present disclosure, the adjustment member includes a plate-shaped body and a mounting disc portion disposed at an end of the plate-shaped body. The mounting disc portion is rotatably mounted in the exhaust channel. The position sensor has an electrical contact, and the mounting portion has a contact protrusion provided on a side of the mounting disc portion facing towards the electrical contact. The contact protrusion is configured to abut with the electrical contact when the adjustment member moves to cover the first air inlet.

In some embodiments of the present disclosure, the first air inlet and the second air inlet are gradually inclined towards each other away from the exhaust channel, to enable a first gas entering the exhaust channel through the first air inlet to gradually flow towards a second gas entering the exhaust channel through the second air inlet.

In some embodiments of the present disclosure, the housing has an air guide channel. A channel port of the air guide channel at an end of the air guide channel is configured to be connected to the air outlet of the tub, and a channel port of the air guide channel at another end of the air guide channel is formed as the first air inlet. The air guide channel is extending along a curved path to guide the first gas in the exhaust channel to flow towards the second air inlet.

In some embodiments of the present disclosure, the exhaust system further includes a first fan disposed in the exhaust channel and electrically connected to the controller.

In some embodiments of the present disclosure, the exhaust system further includes a sensor including a temperature sensing module and a humidity sensing module. The sensor is disposed at the exhaust channel and is configured to sense a temperature and humidity at the exhaust channel, respectively. The controller is electrically connected to the sensor to control the adjustment mechanism to operate based on the received temperature and humidity.

In some embodiments of the present disclosure, the exhaust system further includes a first fan disposed in the exhaust channel and electrically connected to the controller. The sensor is arranged upstream or downstream of the first fan; and/or the sensor is arranged adjacent to the first fan.

In addition, in order to achieve the above objects, according to an eighth aspect of the present disclosure, a dishwasher is further provided. The dishwasher includes a shell, a tub disposed in the shell, and the exhaust system according to the above seventh aspect. The exhaust system is mounted at the shell.

In some embodiments of the present disclosure, the dishwasher further includes a second fan disposed in the tub and electrically connected to the controller, and/or a heater disposed at the tub and electrically connected to the controller.

In addition, in order to achieve the above objects, according to a ninth aspect of the present disclosure, a method for controlling a dishwasher is further provided. The dishwasher includes a shell, a tub, and an adjustment mechanism. The shell has an exhaust channel, and a first air inlet and a second air inlet that are in communication with the exhaust channel respectively. The first air inlet is configured to introduce a first gas discharged from the tub, and the second air inlet is configured to introduce a second gas with humidity lower than humidity of the first gas. The method includes: controlling, when the dishwasher is at a washing stage, the adjustment mechanism to cover the first air inlet; and controlling, when the dishwasher is at an exhaust stage, the adjustment mechanism to expose each of the first air inlet and the second air inlet, to control a ratio of the first gas entering the exhaust channel to the second gas entering the exhaust channel.

In some embodiments of the present disclosure, the dishwasher further includes a sensor and a first fan that are disposed at the exhaust channel. The sensor includes a humidity sensing module. The controlling, when the dishwasher is at the exhaust stage, the adjustment mechanism to expose each of the first air inlet and the second air inlet, to control the ratio of the first gas entering the exhaust channel to the second gas entering the exhaust channel includes: controlling, when the dishwasher is at the exhaust stage, the adjustment mechanism to expose each of the first air inlet and the second air inlet and controlling the first fan to operate at a first predetermined rotational speed; obtaining humidity of the exhaust channel; and adjusting a rotational speed of the first fan to a second predetermined rotational speed smaller than the first predetermined rotational speed when the humidity decreases to a target humidity threshold.

In some embodiments of the present disclosure, the dishwasher further includes a second fan and a heater that are disposed at the tub. The method further includes, prior to said adjusting the rotational speed of the first fan to the second predetermined rotational speed smaller than the first predetermined rotational speed when the humidity decreases to the target humidity threshold: adjusting the second fan to operate at a predetermined minimum rotational speed when the humidity decreases to a first humidity threshold; controlling a rotational speed of the second fan to gradually increase when the humidity is lower than the first humidity threshold and greater than a second humidity threshold, in which the first humidity threshold, the second humidity threshold, and the target humidity threshold decrease sequentially; and controlling the heater to operate and the rotational speed of the first fan to decrease when the humidity is lower than the first humidity threshold and greater than the second humidity threshold and the rational speed of the second fan increases to a predetermined maximum rotational speed.

In some embodiments of the present disclosure, the sensor further includes a temperature sensing module. The method further includes, subsequent to said adjusting the rotational speed of the first fan to the second predetermined rotational speed smaller than the first predetermined rotational speed when the humidity decreases to the target humidity threshold: obtaining a temperature of the exhaust channel; and controlling, when the temperature is greater than a predetermined temperature threshold, the first fan, the second fan, and the heater to be switched off, and controlling, after a predetermined time, the first fan to operate at a predetermined maximum rotational speed and the second fan to operate at the predetermined maximum rotational speed and controlling the heater to operate.

In some embodiments of the present disclosure, the method for controlling the dishwasher further includes, subsequent to said obtaining the temperature of the exhaust channel: controlling the heater to be switched off and controlling the first fan to operate at the predetermined maximum rotational speed and the second fan to operate at the predetermined maximum rotational speed, when the temperature is smaller than or equal to a predetermined temperature threshold; and controlling, when the dishwasher satisfies a predetermined condition, the first fan and the second fan to be switched off.

In the technical solution according to the present disclosure, the controller can implement intelligent operation of the adjustment mechanism based on predetermined rules or actual requirements. The adjustment mechanism respectively adjusts the flow rate of the first gas entering the exhaust channel through the first air inlet and the flow rate of the second gas entering the exhaust channel through the second air inlet, to allow for an adjustable ratio of the first gas at the exhaust channel to the second gas at the exhaust channel. Therefore, the flow rate of the first gas entering the exhaust channel can be effectively reduced when a large amount of the first gas is discharged from the tub. In addition, it is possible to introduce sufficient second gas into the first gas to realize rapid drying of the first gas. In addition, when a small amount of the first gas is discharged from the tub, it is possible to availably increase the flow rate of the first gas entering the exhaust channel and enhance drying efficiency of the first gas. In addition, the first air inlet is in direct communication with the exhaust channel, allowing the first gas discharged from the tub to be dried directly and avoiding generation of condensate water due to formation of a cooling medium on a path where the first gas enters the exhaust channel. In the technical solution according to the present disclosure, the drying efficiency of the first gas discharged from the tub can be improved, and a drying effect is also optimized by lowering or even eliminating the generation of condensate water.

When the first air inlet is the steam inlet and the second air inlet is the air inlet, the first gas is the steam and the second gas is the air. In this case, the adjustment mechanism can adjust the flow rate of the steam entering the exhaust channel through the steam inlet and/or a flow rate of the external air entering the exhaust channel through the air inlet, allowing for an adjustable ratio of the steam at the exhaust channel to the air at the exhaust channel. Therefore, the flow rate of the steam entering the exhaust channel can be effectively lowered when a large amount of the steam is discharged from the tub. In addition, it is possible to introduce sufficient air to the steam to realize rapid drying of the steam. In addition, when a small amount of the steam is discharged from the tub, it is possible to effectually increase the flow rate of the steam entering the exhaust channel and enhance drying efficiency of the steam. Further, the adjustment device is provided, which enables the steam discharged from the tub to be dried directly and prevents the generation of condensate water due to formation of a cooling medium on a path where the steam enters the exhaust channel. In the technical solution according to the present disclosure, the drying efficiency of the steam discharged from the tub can be improved, and the drying effect is also optimized by reducing or even eliminating the generation of condensate water.

BRIEF DESCRIPTION OF THE DRAWINGS

In order to clearly explain technical solutions of the embodiments of the present disclosure or in the related art, accompanying drawings used in the description of the embodiments or the related art are briefly described below. Obviously, the accompanying drawings as described below are merely some embodiments of the present disclosure. Based on structures illustrated in these drawings, other accompanying drawings may be obtained by those of ordinary skill in the art without creative effort.

DESCRIPTION OF REFERENCE NUMERALS

Figure 1:
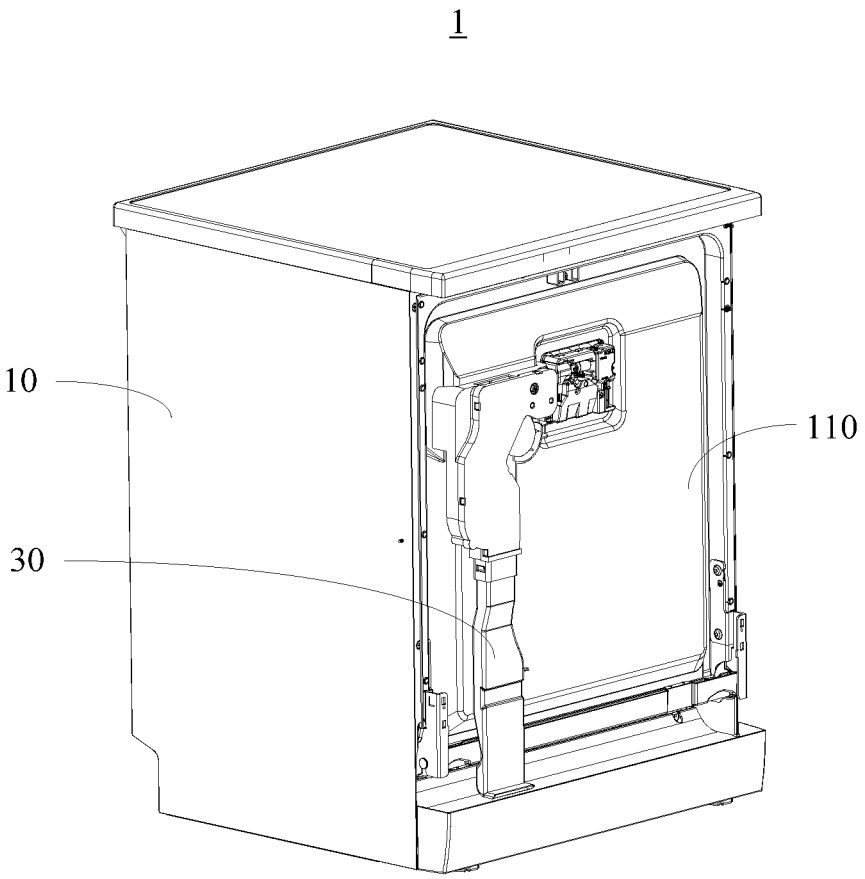
FIG. 1 is a perspective view of an embodiment of a dishwasher according to the present disclosure.

| Numerals | Name |
|---|---|
| 1 | dishwasher |
| 10 | shell |
| 110 | inner door body |
| 20 | tub |
| 21 | air outlet |
| 30 | exhaust system |
| 400 | housing |
| 400a | first cavity casing |
| 400b | second cavity casing |
| 401 | first housing |
| 401a | bottom housing |
| 401b | cover housing |
| 402 | second housing |
| 402a | bending section |
| 403 | snap |
| 404 | snap hole |
| 405 | engagement rib |
| 406 | fixed base |
| 406a | boss |
| 407 | engagement groove |
| 408 | reinforcement rib |
| 410 | exhaust channel |
| 410a | mixing channel section |
| 410b | air outlet channel section |
| 420 | first air inlet/steam inlet |
| 430 | second air inlet/air inlet |
| 440 | exhaust outlet |
| 450 | connection wall |
| 460 | air guide channel |
| 470 | air guide structure |
| 480 | engagement portion |
| 460' | bump |
| 500 | adjustment device |
| 510 | adjustment member |
| 511 | plate-shaped body |
| 512 | mounting disc portion |
| 513 | abutment side |
| 513a | elastic seal layer |
| 513b | protrusion |
| 514 | contact protrusion |
| 520 | drive component |
| 521 | drive motor |
| 522 | rotary portion |
| 522a | driving rotary portion |
| 522b | driven rotary portion |
| 523 | teeth |
| 600 | position sensor |
| 610 | electrical contact |
| 700 | first fan |
| 800 | sensor |
| 901 | first gas/steam |
| 902 | second gas/air |
| 903 | mixed gas |

The implementation, functional characteristics, and advantages of the present disclosure will be further described with reference to the drawings.

DETAILED DESCRIPTION

Technical solutions according to embodiments of the present disclosure will be described below in combination with accompanying drawings of the embodiments of the present disclosure. Obviously, the embodiments described below are only a part of the embodiments of the present disclosure, rather than all of the embodiments. On a basis of the embodiments in the present disclosure, all other embodiments obtained by a person skilled in the art without creative labor shall fall within the protection scope of the present disclosure.

It should be noted that, when the embodiments of the present disclosure relate to directional indication (terms such as over, below, left, right, front, rear, etc.), the directional indication is only used to explain a relative position relationship, a motion situation, etc. between the components under a predetermined specific posture (as shown in the drawings), and the directional indication also changes accordingly when the specific posture changes.

In addition, if the embodiments of the present disclosure relate to descriptions such as "first" or "second", the descriptions of "first", "second", or the like are only for descriptive purposes, rather than indicating or implying relative importance or implicitly indicating the number of indicated technical features. Therefore, the features defined with "first" or "second" can explicitly or implicitly include at least one of the features. The meaning of "and/or" appearing in the entire text includes three parallel solutions. For example, "A and/or B" may include three cases where only A solution is satisfied, A and B solutions are satisfied at the same time, and only B solution is satisfied. In addition, the technical solutions between various embodiments may be combined with each other, but must be based on that they can be achieved by a person of ordinary skill in the art. When the combination of the technical solutions is contradictory or unachievable, it shall be deemed that such combination of the technical solutions does not exist, nor is within the scope of the present disclosure.

As living standards continue to improve, users are demanding more and more usage performance from a household dishwasher, including drying performance. A variety of drying methods is currently applied in a dishwasher on the market, mainly including residual heat drying, internal circulation ventilation drying, and external circulation ventilation drying.

Here, residual heat drying is achieved by raising a washing temperature by increasing a temperature of water in a tub, and utilizing residual heat in the tub for natural drying. However, this method has the disadvantages of high energy consumption and slow drying speed. Internal circulation ventilation drying involves using a fan to extract wet steam from the tub to a medium that may remove water from the steam. In addition, the dehumidified dry air is blown into the tub to reduce humidity in the tub and achieve the purpose of drying tableware. Currently, the main methods for removing water from the steam are condensation and adsorption. However, condensation has low efficiency and is difficult to achieve rapid drying. Adsorption requires adding adsorbent materials, which may cause odor problems in the tub. In addition, both of the two water removal methods require complex devices and have higher costs. External circulation drying, i.e., directly discharging the steam from the tub to an outdoor space. This method has the advantages of a simple device and high efficiency, however, it has the drawbacks of heat loss and the risk of condensate water forming outside the dishwasher.

Although many drying methods are available, these methods have the drawback such as easy generating of condensate water while improving drying efficiency.

In view of the above, the present disclosure provides an adjustment device applied in an exhaust system of a dishwasher. The dishwasher may be used to clean tableware, cookware, knives, and the like. Referring to FIG. 1 to FIG. 9, the accompanying drawings illustrate exemplary embodiments where the adjustment device 500 according to the present disclosure is applied in an exhaust system 30 of a dishwasher 1.

The present disclosure provides an exhaust system 30 applied in the dishwasher 1.

Figure 2:
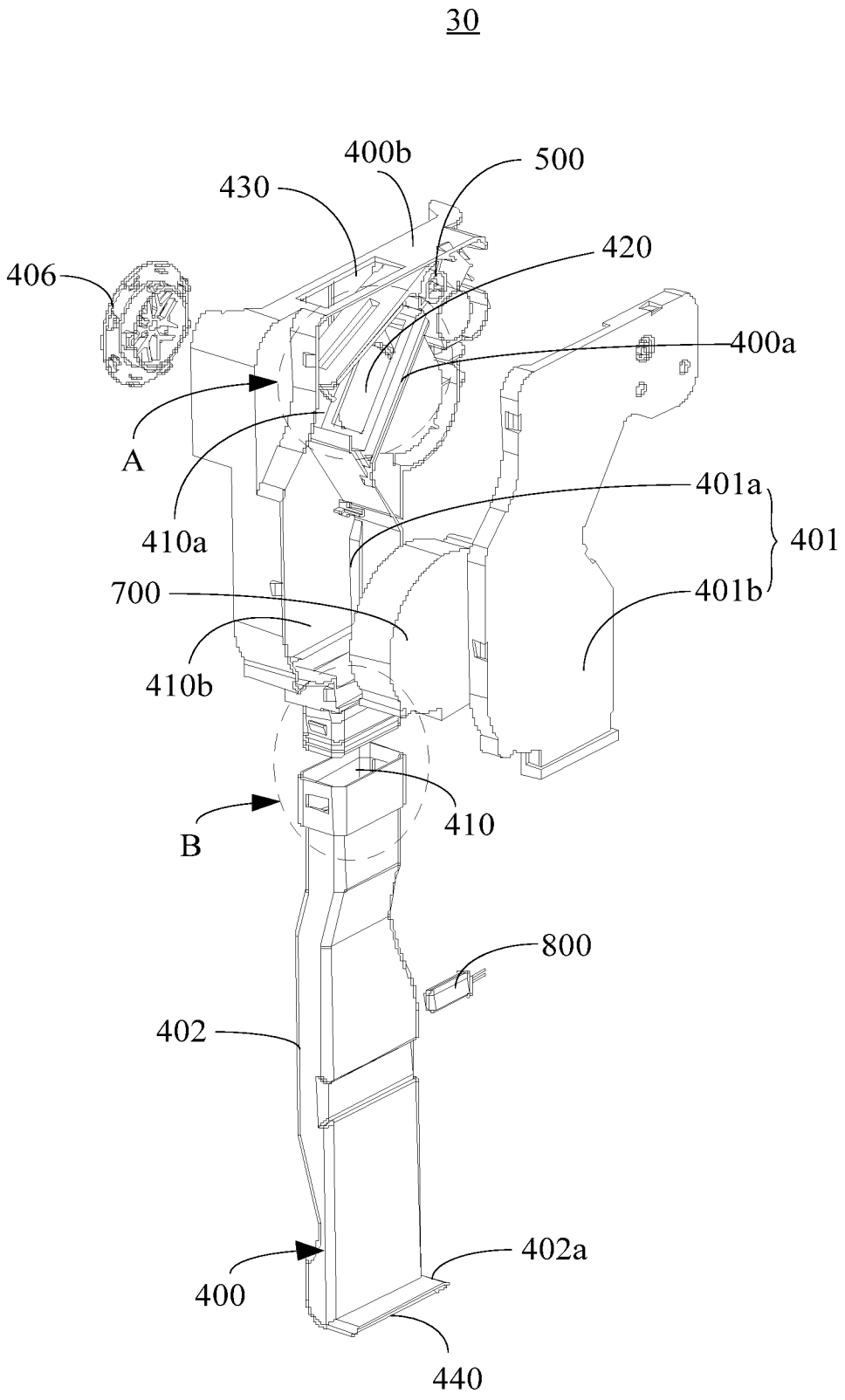
FIG. 2 is a schematic exploded view of a partial structure of an exhaust system in FIG. 1.
Figure 3:
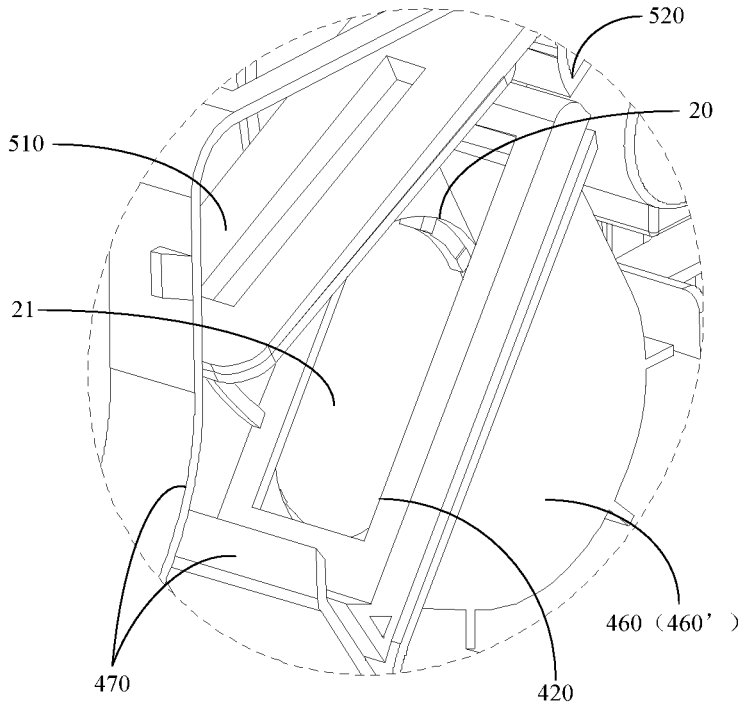
FIG. 3 is a schematic view of an enlarged structure at part A in FIG. 2.

Referring to FIG. 1 to FIG. 3, the present disclosure provides a dishwasher 1 including a shell 10, a tub 20, and the exhaust system 30. The tub 20 is disposed in the shell 10. The exhaust system 30 is mounted at the shell 10.

The tub 20 is typically disposed inside the shell 10. When the tub 20 is at a washing stage, i.e., after to-be-washed kitchen utensils inside the tub 20 have been washed, high-temperature and high-humidity steam (i.e., a first gas 901, steam 901 in the later embodiments) may be generated. After the washing is completed, it is necessary to dry the high-temperature and high-humidity steam for ensuring continuous use of the tub 20. Based on this, in this embodiment, the tub 20 at least has an air outlet 21. The exhaust system 30 is in communication with the air outlet 21 of the tub 20. When the tub 20 is at an exhaust stage, the high-temperature and high-humidity steam is discharged through the air outlet 21 of the tub 20 and enters the exhaust system 30. Under the action of the exhaust system 30, rapid drying can be achieved without generating the condensate water.

The exhaust system 30 may be arranged at any suitable position within the shell 10. For example, in exemplary applications, the exhaust system 30 may be disposed at an interior of the shell 10 or outside of the shell 10. When the exhaust system 30 is disposed outside of the shell 10, disassembly, assembly, and other operations of the exhaust system 30 do not interfere with normal operation of internal functional components of the dishwasher 1, which facilitates improving convenience of use. In addition, the exhaust system 30 may be disposed at the top, bottom, or any sides of the shell 10. In practical applications, the dishwasher 1 is usually embedded in predetermined mounting grooves of indoor walls, cabinets, or the like, with only a front side of the dishwasher 1 being exposed. Therefore, in an embodiment, the exhaust system 30 may be further disposed at the front side of the dishwasher 1, which facilitates daily maintenance of the exhaust system 30 and aids in discharge of airflow.

When the exhaust system 30 is disposed at the front side of the shell 10, in an exemplary embodiment, the shell 10 may include a casing with a side opening and a door body. The door body movably covers the opening of the casing. The tub 20 is disposed inside the casing. Further, the door body may include an outer door body and an inner door body 110 that are stacked from inwards to outwards. The exhaust system 30 is disposed at an outer side of the inner door body 110 and is covered by the outer door body. Therefore, it facilitates to achieve independent installation between the exhaust system 30 and the tub 20 through the inner door body 110. Further, the exhaust system 30 is protected by the outer door body, improving entire aesthetics of the dishwasher. Alternatively, in other configurations, the tub 20 may be disposed, for example, at the door body. In this case, the tub 20 and the exhaust system 30 are located at an inner side or an outer side of the door body, respectively.

Figure 5:
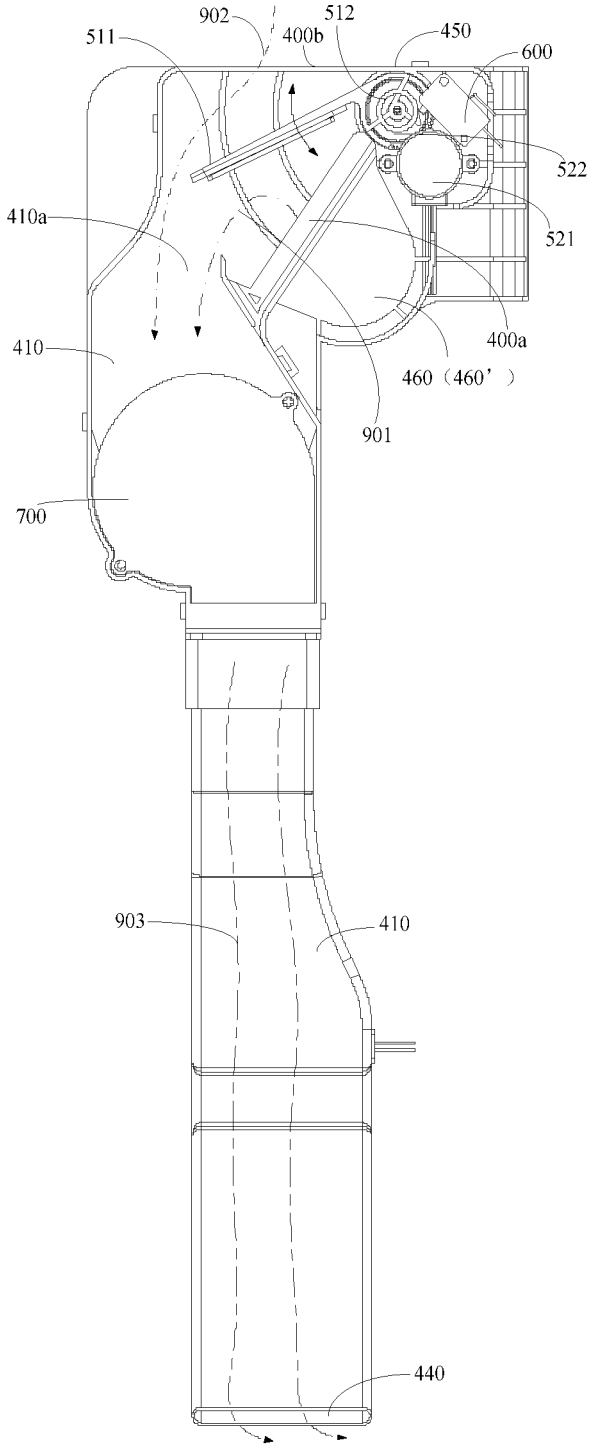
FIG. 5 is a schematic main view of the exhaust system in FIG. 2 after a cover housing is removed.

As illustrated in FIG. 5, the exhaust system 30 described in the present disclosure includes a housing 400 and an adjustment device 500. An exhaust channel 410, a first air inlet 420, and a second air inlet 430 are formed at the housing 400. The first air inlet 420 and the second air inlet 430 are in communication with the exhaust channel 410, respectively. The first air inlet 420 is in communication with the tub 20 of the dishwasher 1 to introduce a first gas 901 discharged from the tub 20. The second air inlet 430 is configured to introduce a second gas 902 with humidity lower than humidity of the first gas 901.

The adjustment device 500 includes an adjustment mechanism 500 and a controller. The adjustment mechanism 500 is configured to, under control of the controller, respectively adjust a flow rate of a first gas 901 entering the exhaust channel 410 through the first air inlet 420 and a flow rate of a second gas 902 entering the exhaust channel 410 through the second air inlet 430, to control a ratio of the first gas 901 entering the exhaust channel 410 to the second gas 902 entering the exhaust channel 410.

That is, humidity of the second gas 902 is lower than humidity of the first gas 901.

In the technical solutions according to the present disclosure, the controller can implement intelligent operation of the adjustment mechanism based on the predetermined rules or actual requirements. The adjustment mechanism respectively adjusts the flow rate of the first gas 901 entering the exhaust channel 410 through the first air inlet 420 and the flow rate of the second gas 902 entering the exhaust channel 410 through the second air inlet 430, to allow for an adjustable ratio of the first gas 901 at the exhaust channel 410 to the second gas 902 at the exhaust channel 410. Therefore, the flow rate of the first gas 901 entering the exhaust channel 410 can be effectively reduced when a large amount of the first gas 901 is discharged from the tub 20. Moreover, it is possible to introduce sufficient second gas 902 to the first gas 901 to realize rapid drying of the first gas 901. In addition, when a small amount of first gas 901 is discharged from the tub 20, it is possible to effectively increase the flow rate of the first gas 901 entering the exhaust channel 410 and enhance drying efficiency of the first gas 901. In addition, the first air inlet 420 is in direct communication with the exhaust channel 410, allowing the first gas 901 discharged from the tub 20 to be dried directly and preventing generation of condensate water due to formation of a cooling medium at a path where the first gas 901 enters the exhaust channel. In the technical solutions according to the present disclosure, the drying efficiency of the first gas 901 discharged from the tub 20 can be enhanced, and a drying effect is also optimized by decreasing or even eliminating the generation of condensate water.

The first air inlet 420 of the housing 400 is arranged adjacent to the second air inlet 430 of the housing 400, to facilitate rapid mixing of the first gas 901 and the second gas 902. The first gas 901, as mentioned above, generally refers to the high-temperature and high-humidity steam discharged through the air outlet 21 of the tub 20. The second gas 902 may be any gas drier than the first gas 901. In an exemplary embodiment, the second gas 902 may be external air, a dry gas specially introduced from other parts of the dishwasher 1 or from an external device, and the like. Compared with the first gas 901, the second gas 902 is drier. Therefore, when the first gas 901 is mixed with the second gas 902, a mixed gas 903 can achieve rapid drying by neutralizing the humidity of the first gas 901 and the humidity of the second gas 902.

An airflow area of the first air inlet 420 and an airflow area of the second air inlet 430 may be, in some embodiments of the present disclosure, set to be substantially the same, or different from each other as desired.

The housing 400 generally has an exhaust outlet 440 in communication with the exhaust channel 410 to discharge the mixed gas 903 obtained by mixing the first gas 901 and the second gas 902. In some embodiments, the first air inlet 420 and the second air inlet 430 are arranged adjacent to an end of the exhaust channel 410, and the exhaust outlet 440 may be disposed at another end of the exhaust channel 410. In this way, it is possible to appropriately prolong a flow path of the mixed gas 903. Therefore, it is possible to achieve sufficient drying of the first gas 901 by the second gas 902.

An extending direction of the exhaust channel 410 relative to the shell 10 is not limited. The exhaust channel 410 may extend in a horizontal direction, in an up-down direction, or in any other directions. In some embodiments of the present disclosure, when the exhaust channel 410 extends in the up-down direction, the exhaust outlet 440 is formed at a lower end of the exhaust channel 410, which facilitates to accelerate a discharge speed of the mixed gas 903 to some extent.

In an exemplary embodiment, the exhaust channel 410 may extends downwards and then be bent and extend in the horizontal direction to form a bending section 402*a*. In this case, the exhaust outlet 440 is formed at an end of the bending section 402*a* to guide the mixed gas 903 to be discharged in the horizontal direction. In this case, the horizontal direction may be a front-rear direction of the dishwasher 1 in an exemplary embodiment.

The housing 400 may be integrally formed or formed by assembling at least two housing structures together. When the housing 400 includes at least two housing structures, the exhaust channel 410 may be formed at any one of the at least two housing structures. For example, in an embodiment, the housing 400 includes a first housing 401 and a second housing 402 that are arranged from top to bottom. The exhaust channel 410 extends from the first housing 401 to the second housing 402. The first housing 401 and the second housing 402 are arranged in a detachable manner.

Figure 4:
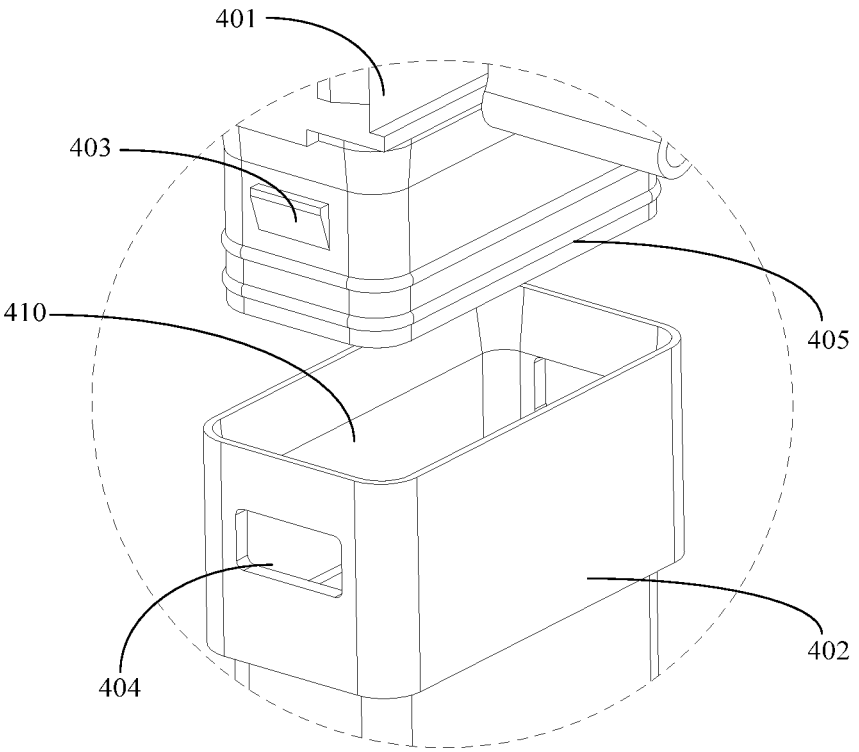
FIG. 4 is a schematic view of an enlarged structure at part B in FIG. 2.

An exemplary form of the detachable manner is not limited. As illustrated in FIG. 2 and FIG. 4, an end of the first housing 401 is nested to an end of the second housing 402, and at the nesting between the first housing 401 and the second housing 402, the first housing 401 is provided with a connector, and the second housing 402 is provided with a mating connector connected to the connector.

The first housing 401 may be at least partially nested to the second housing 402. One of the connector and the mating connector is a snap 403, and the other one of the connector and the mating connector is a snap hole 404. In this way, the snap 403 is provided at the nesting of one of the first housing 401 and the second housing 402, and the snap hole 404 is formed at the nesting of the other one of the first housing 401 and the second housing 402. The snap 403 and the snap hole 404 are in snap-in fit with each other. Therefore, a detachable connection between the first housing 401 and the second housing 402 is achieved. Further, a snap rib 405 may be provided around the nesting between the first housing 401 and the second housing 402. In some embodiments of the present disclosure, the snap rib 405 may be elastic to generate interference when the first housing 401 is nested to the second housing 402, which facilitates a secure connection between the first housing 401 and the second housing 402.

In addition, the first housing 401 and/or the second housing 402 may include a bottom housing 401*a* and a cover housing 401*b*. The bottom housing 401*a* has one side fixedly mounted at the shell 10 and another side formed with an opening. The cover housing 401*b* covers the opening of the bottom housing 401*a*. At least part of a channel section of the exhaust channel 410 is formed by enclosing the cover housing 401*b* and the bottom housing 401*a*. The bottom housing 401*a* may be detachably connected to the cover housing 401*b* through screw fastening, adhesive fastening, snap fastening, adsorption fastening, or the like.

The adjustment device 500 may include, but is not limited to, an adjustment mechanism and a controller. The controller may be an electric controller such as a control unit, and a control circuit, or an operation component that converts external forces into driving forces for a drive component 520, such as, an operation handle, a handwheel, and a knob. In the following embodiments, as an example, the controller is an electric controller including a control unit, to achieve intelligent automation of the exhaust system 30.

The adjustment mechanism acts on at least one of the first air inlet 420 and the second air inlet 430 to achieve control of the flow rate of the first gas 901 and the flow rate of the second gas 902 by correspondingly changing the airflow area of the first air inlet 420 and/or the airflow area of the second air inlet 430. Therefore, the ratio of the first gas 901 at the exhaust channel 410 to the second gas 902 at the exhaust channel 410 is adjustable.

At least two adjustment mechanisms may be provided. The two adjustment mechanisms are disposed at the first air inlet 420 and the second air inlet 430, respectively. Therefore, it is possible to independently adjust a gas flow rate of the first air inlet 420 and a gas flow rate of the second air inlet 430.

One adjustment mechanism may also be provided, allowing for simultaneous adjustment of the gas flow rate of the first air inlet 420 and the gas flow rate of the second air inlet 430.

In an embodiment, the adjustment mechanism includes an adjustment member 510 movably mounted at the housing 400 and a drive component 520 configured to drive movement of the adjustment member 510. The adjustment member 510 is mounted between the first air inlet 420 and the second air inlet 430, and movably arranged between the first air inlet 420 and the second air inlet 430. The adjustment member 510 is configured to, when driven by the drive component 520, move towards the first air inlet 420 to fully cover the first air inlet 420 and to move towards the second air inlet 430 to fully cover the second air inlet 430.

It can be understood that during the movement of the adjustment member 510 towards the first air inlet 420, an orthographic projection area of the adjustment member 510 on the first air inlet 420 gradually increases. That is, a shielding area of the adjustment member 510 for the first air inlet 420 gradually increases, resulting in a gradual reduction in a flow rate of the first gas 901 at the first air inlet 420 until the flow rate of the first gas 901 becomes zero when the first air inlet 420 is fully covered by the adjustment member 510; otherwise, during the movement of the adjustment member 510 towards the second air inlet 430, an orthographic projection area of the adjustment member 510 on the second air inlet 430 gradually increases. That is, a shielding area of the adjustment member 510 for the second air inlet 430 gradually increases, resulting in a gradual reduction in a flow rate of the second gas 902 at the second air inlet 430 until the flow rate of the second gas 902 becomes zero when the second air inlet 430 is fully covered by the adjustment member 510.

It should be noted that, when the housing 400 has a connection wall 450 located between the first air inlet 420 and the second air inlet 430, an orthographic projection area of the adjustment member 510 on the connection wall 450 is set to be smaller than or equal to an area of the connection wall 450 and is greater than or equal to a maximum one of the airflow area of the first air inlet 420 and the airflow area of the second air inlet 430. In this case, the adjustment member 510 can only shield the first air inlet 420 or the second air inlet 430 during its movement. When the adjustment member 510 moves between the first air inlet 420 and the second air inlet 430, the adjustment member 510 does not shield either the first air inlet 420 or the second air inlet 430.

In some embodiments of the present disclosure, the orthographic projection area of the adjustment member 510 on the connection wall 450 is set to be greater than the area of the connection wall 450 and is greater than or equal to the maximum one of the airflow area of the first air inlet 420 and the airflow area of the second air inlet 430. In this case, the adjustment member 510 can at least partially shield the first air inlet 420 and/or the second air inlet 430 during its movement. Moreover, the airflow area of one of the first air inlet 420 and the second air inlet 430 gradually increases, and the airflow area of the other one of first air inlet 420 and the second air inlet 430 gradually decreases, which facilitates to accelerate adjustment for the ratio of the first gas 901 to the second gas 902.

Through the arrangement of the adjustment member 510 and the drive component 520 as described above, the adjustment mechanism may be defined to provide either stepped or stepless adjustment for the flow rate of the first gas 901 entering the exhaust channel 410 through the first air inlet 420 and the flow rate of the second gas 902 entering the exhaust channel 410 through the second air inlet 430 as desired.

Various exemplary solutions of the adjustment mechanism for implementing the above functions are provided below.

In an embodiment, the adjustment member 510 is translatably arranged on the connection wall 450. That is, the adjustment member 510 is movable substantially relative to a plane where the connection wall 450 is located. The adjustment member 510 is driven by the drive component 520 to translate. Therefore, the adjustment member 510 translates towards the first air inlet 420 to fully cover the first air inlet 420 and translates towards the second air inlet 430 to fully cover the second air inlet 430.

It can be understood that the translation may be along a straight line. For example, the adjustment member 510 is translatably arranged in a direction of a connection line between the first air inlet 420 and the second air inlet 430, to shorten a translation path of the adjustment member 510. The translation may also be along a curve line, which can change a shielding direction of the adjustment member 510 for the first air inlet 420 and/or the second air inlet 430. Therefore, it is possible to facilitate refining a shielding variable of the adjustment member 510 for the first air inlet 420 and/or the second air inlet 430, and improve an adjustment precision of the ratio of the first gas 901 to the second gas 902.

In an embodiment, the adjustment member 510 has a mounting end and a free end opposite to the mounting end. The mounting end is rotatably mounted at the connection wall 450. The drive component 520 drives the mounting end to rotate. Therefore, the free end of the adjustment member 510 may rotate towards the first air inlet 420 to enable the adjustment member 510 to fully cover the first air inlet 420, and to rotate towards the second air inlet 430 to enable the adjustment member 510 to fully cover the second air inlet 430. The adjustment member 510 is constructed in a plate-like shape substantially, or at least has a plate surface facing towards the first air inlet 420 and a plate surface facing towards the second air inlet 430.

In some embodiments, the mounting end of the adjustment member 510 may be rotatably disposed along a rotation axis extending in a direction substantially perpendicular to the connection wall 450, to allow the plate surfaces of the adjustment member 510 to substantially slide along the plane where the connection wall 450 is located. In this case, one free end may be provided to separately shield the first air inlet 420 or the second air inlet 430 during each rotation; or two free ends may be provided, are located on two opposite sides of the mounting end respectively, and are of a general blade shape.

Alternatively, referring to FIG. 2 and FIG. 3, the mounting end of the adjustment member 510 may be rotatably disposed along a rotation axis extending in a direction substantially parallel to the connection wall 450, to allow the plate surfaces of the adjustment member 510 to rotate relative to the plane where the connection wall 450 is located. In this way, an air flowing cavity for the first gas 901 and/or the second gas 902 can be formed by enclosing the adjustment member 510 and an inner wall of the exhaust channel 410 at an opposite side during the rotation of the adjustment member 510. The air flowing cavity is flared in an airflow direction. Therefore, it facilitates sufficient diffusion of the first gas 901 and/or the second gas 902 during their flow, aiding in rapid mixing of the first gas 901 with the second gas 902.

In an embodiment, the adjustment member 510 may include a fixed plate and a movable plate. The fixed plate fixedly covers the first air inlet 420 and/or the second air inlet 430. As an example, the fixed plate fixedly covers the first air inlet 420. A plurality of first air flowing holes is defined at the fixed plate in a thickness direction of the fixed plate and penetrates the fixed plate. A plurality of second air flowing holes is defined at the movable plate in a thickness direction of the movable plate and penetrates the movable plate. The movable plate is movably arranged relative to the fixed plate. In this case, the second air flowing hole is moveably arranged at an orthographic projection region of the fixed plate during movement of the movable plate. The second air flowing hole may move to at least partially overlap or be completely misaligned with the first air flow hole to form air flowing holes of different shapes and sizes distributed at intervals. The first gas 901 can flow through these air flowing holes dispersedly and quantitatively.

In addition, as described in the above embodiments, the adjustment member 510 has the mounting end and the free end opposite to the mounting end. When the mounting end is rotatably mounted at the connection wall 450, referring to FIG. 6 to FIG. 8, the drive component 520 includes a drive motor 521 and two rotary portions 522. The drive motor 521 is mounted at the housing 400. In some embodiments, the drive motor 521 is fixedly mounted in the exhaust channel 410. The drive motor 521 is electrically connected to the controller to be controlled by the controller to operate. The two rotary portions 522 are mounted rotatably at the exhaust channel 410 and disposed in parallel to each other relative to the inner wall of the exhaust channel 410. One of the two rotary portions 522 is connected to the drive motor 521, and another one of the two rotary portions 522 is connected to the mounting end. The two rotary portions 522 have surfaces facing towards each other. The two rotary portions 522 are provided with teeth 523 on the surfaces of the two rotary portions 522 facing towards each other, and the teeth 523 are engaged with each other. It can be understood that each of the rotary portions 522 is of a generally disc-shaped, and the teeth 523 are provided at a side of the disc. In this way, the two rotary portions 522, when driven by the drive motor 521, perform transmission through the teeth 523 engaged with each other to drive the mounting end to rotate.

The rotary portion 522 connected to the drive motor 521 is defined as a driving rotary portion 522*a*, and the rotary portion 522 connected to the mounting end of the adjustment member 510 is defined as a driven rotary portion 522*b*. In an exemplary embodiment, at least one of the driving rotary portion 522*a* and the driven rotary portion 522*b* may be arranged at the drive motor 521 and/or the adjustment member 510. Taking the driven rotary portion 522*b* as an example, the mounting end of the adjustment member 510 has an arc-shaped surface at a side facing away from the free end of the adjustment member 510, and the teeth 523 are disposed at the arc-shaped surface. The teeth 523 may at least partially extend and be distributed at the arc-shaped surface, and the driven rotary portion 522*b* is arranged at the arc-shaped surface.

In another embodiment, at least one of the driving rotary portion 522*a* and the driven rotary portion 522*b* may be configured as a separate member and is independently disposed from the corresponding drive motor 521 and/or the adjustment member 510. In exemplary applications, the at least one of the driving rotary portion 522*a* and the driven rotary portion 522*b* may be configured as a gear structure. The driving rotary portion 522*a* and the driven rotary portion 522*b* have their own rotation axes spaced apart from or arranged in parallel, allowing for better engagement and transmission between the driving rotary portion 522*a* and the driven rotary portion 522*b*.

It should be noted that, the drive component 520 may also be constructed as desired. Taking rotational mounting of the adjustment member 510 as an example, in an embodiment, the drive component 520 may only include a drive motor 521. The drive motor 521 is in a direct drive connection with the mounting end, or is in a drive connection with the mounting end by means of a coupling or other structures, to drive the mounting end to rotate. In an embodiment, the drive component 520 may include only a wax motor. In an embodiment, the drive component 520 may include a driver and a transmission assembly. The transmission assembly may be a linkage mechanism, a lever mechanism, an electromagnetic transmission mechanism, or the like. Details thereof will be omitted herein for brevity.

In addition, in an embodiment, the exhaust system 30 further includes a connection structure disposed at the adjustment member 510 and/or the housing 400. The adjustment member 510 has a first plate surface for covering the first air inlet 420. The connection structure is configured to, when the adjustment member 510 moves to cover the first air inlet 420, connect the first plate surface and the housing 400, thereby preventing the adjustment member 510 from rebounding due to abutting of the adjustment member 510 against the housing 400, which may affect effect of coving the first air inlet 420 with the first plate; and/or the adjustment member 510 has a second plate surface for covering the second air inlet 430. The connection structure is configured to, when the adjustment member 510 moves to cover the second air inlet 430, connect the second plate surface and the housing 400, thereby preventing the adjustment member 510 from rebounding due to the abutting of the adjustment member 510 against the housing 400, which may affect covering the second air inlet 430 with the second plate surface.

It can be understood that when the two connection structures may be provided and are respectively disposed between the first plate surface and an inner wall of the corresponding exhaust channel 410, and between the second plate surface and an inner wall of the corresponding exhaust channel 410, the two connection structures may be constructed to be the same to or different from each other.

There is a plurality of exemplary solutions of the connection structure. As an example, the connection structure is disposed between the first plate surface and the inner wall of the corresponding exhaust channel 410. The connection structure may include a connection portion disposed at the first plate surface and a mating connection portion disposed at the inner wall of the corresponding exhaust channel 410.

In an embodiment, the connection portion may be an adsorption member, and the mating connection portion is a mating adsorption member. A connection between the first plate surface and the inner wall of the corresponding exhaust channel 410 can be achieved through an adsorption effect when the adsorption member and the mating adsorption member move close to each other. The adsorption member may be a suction cup, a magnetic structure, or the like.

In an embodiment, the connection portion may be an adhesive member, and the mating connection portion is a mating adhesive member. The connection between the first plate surface and the inner wall of the corresponding exhaust channel 410 can be achieved by means of an adhesive effect when the adhesive member and the mating adhesive member move close to each other. The adhesive member may be an adhesive tape suitable for a current environment, or the like.

In an embodiment, the connection portion may be a fastener, and the mating connection portion is a mating fastener member. The connection between the first plate surface and the inner wall of the corresponding exhaust channel 410 can be achieved by a fastening effect when the fastener and the mating fastener member move close to each other.

When the drive component 520 includes the driving rotary portion 522*a* and the driven rotary portion 522*b* as described above, the teeth 523 located between the driving rotary portion 522*a* and the driven rotary portion 522*b* and engaged with each other can realize a self-locking of a movement state of the driving rotary portion 522*a* and a movement state of the driven rotary portion 522*b* when the driving rotary portion 522*a* and the driven rotary portion 522*b* do not rotate. In this way, self-locking of a movement state of the adjustment member 510 can be realized. Moreover, a purpose of preventing the adjustment member 510 from rebounding is attained. Therefore, the connection structure is formed by the driving rotary portion 522*a* and the driven rotary portion 522*b* together.

Figure 6:
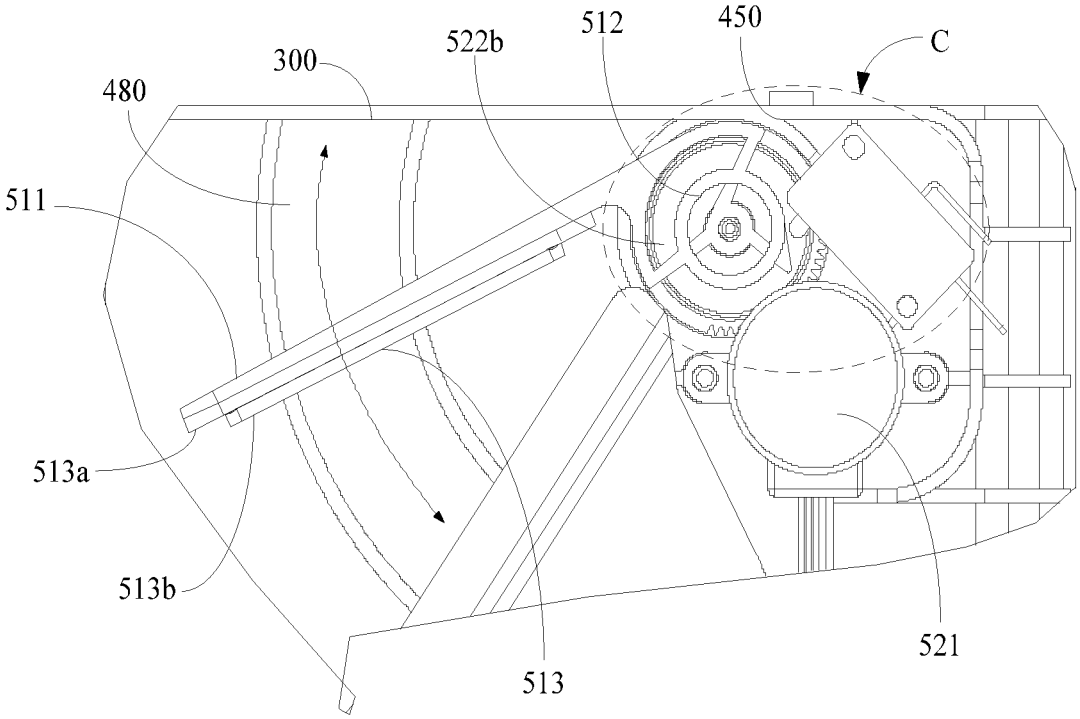
FIG. 6 is a schematic structural view of an adjustment device in FIG. 5.
Figure 8:
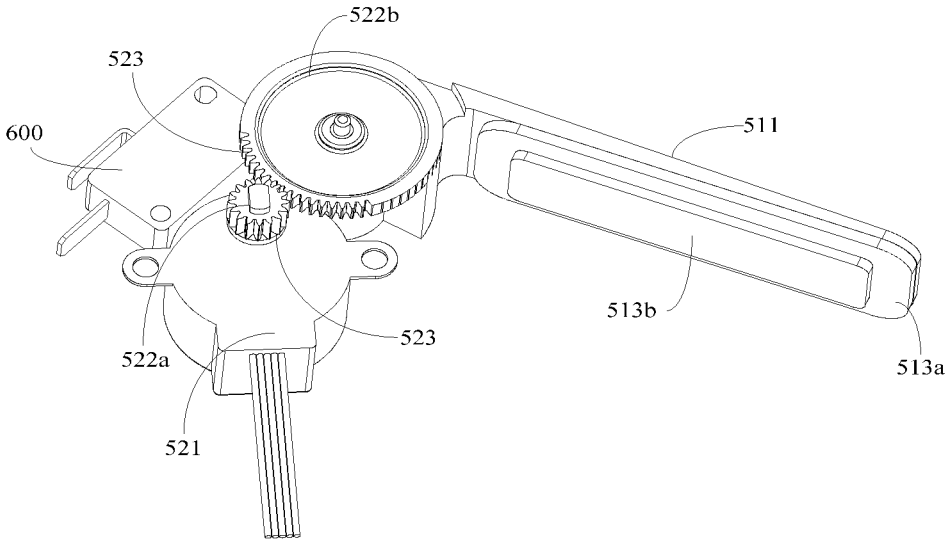
FIG. 8 is a schematic structural view of an adjustment mechanism in FIG. 5.

Referring to FIG. 6 and FIG. 8, in an embodiment, the adjustment member 510 is constructed in a substantially plate-like shape to achieve material efficiency, and has an abutment side 513 facing towards the first air inlet 420 and/or an abutment side 513 facing towards the second air inlet 430. That is, a side where the first plate surface and/or the second plate surface is located is formed as the abutment side 513. An elastic seal layer 513*a* is at least disposed at the abutment side 513 of the adjustment member 510. As an example, the elastic seal layer 513*a* is disposed at the first plate surface. On one hand, the elastic seal layer 513*a* may seal a gap between the first plate surface and a peripheral side of the first air inlet 420 when the first plate surface covers the first air inlet 420, to avoid leakage of the first gas 901; on the other hand, the elastic seal layer 513*a* may relieve a mutual impact between the first plate surface and the peripheral side of the first air inlet 420 when the first plate surface covers the first air inlet 420, to achieve a damping effect, which is helpful to eliminate collision noise and improve a service life of each of the adjustment member 510 and the housing 400.

The elastic seal layer 513*a* may be made of elastic materials such as rubber and silica gel. The elastic seal layer 513*a* and the adjustment member 510 may be integrally formed. In some embodiments, the first plate surface of the adjustment member 510 is at least made of an elastic material; or the elastic seal layer 513*a* and the adjustment member 510 are separately arranged and then are detachably connected to each other. The elastic seal layer 513*a* may be expanded on the entire first plate surface, or may correspond to a connection between the first plate surface and the housing 400.

Further, in an embodiment, a protrusion 513*b* is disposed in a middle of the abutment side 513 of the adjustment member 510. A shape and size of the protrusion 513*b* are adapted to the corresponding first air inlet 420 or the corresponding second air inlet 430. The protrusion 513*b* is configured to be caught into the first air inlet 420 when the adjustment member 510 moves to cover the first air inlet 420, and/or caught into the second air inlet 430 when the adjustment member 510 moves to cover the second air inlet 430.

Similarly, taking the protrusion 513*b* disposed at the first plate surface as an example, the protrusion 513*b* is configured to be caught into the first air inlet 420 when the first plate surface covers the first air inlet 420, which can increase the effect of coving the first air inlet 420 with the first plate surface, and is equivalent to forming the connection structure to facilitate the stable connection between the adjustment member 510 and the housing 400; when the protrusion 513*b* is caught into the first air inlet 420, an outer side surface of the protrusion 513*b* matches with a shape of an outer surface of the housing 400 at a position where the protrusion 513*b* is located, to avoid an unnecessary recess structure from being formed at the outer surface of the housing 400, which facilitates to improve the aesthetics of the whole machine.

Similarly, the protrusion 513*b* and the abutment side 513 may be integrally formed, or the protrusion 513*b* may be separated from the abutment side 513. When the abutment side 513 is provided with the elastic seal layer 513*a* and/or the protrusion 513*b*, the elastic seal layer 513*a* may be spread at the whole plate surface of the abutment side 513 and is sandwiched between the protrusion 513*b* and the abutment side 513; or the elastic seal layer 513*a* is arranged around a peripheral side of the protrusion 513*b*.

Further, a peripheral side wall of the protrusion 513*b* may be at least elastic, to enable the protrusion 513*b* to correspondingly elastically abut with an inner edge of the first air inlet 420 or an inner edge of the second air inlet 430 when the protrusion 513*b* is caught into in the first air inlet 420 or the second air inlet 430, to further enhance sealing effect and connection strength.

Figure 7:
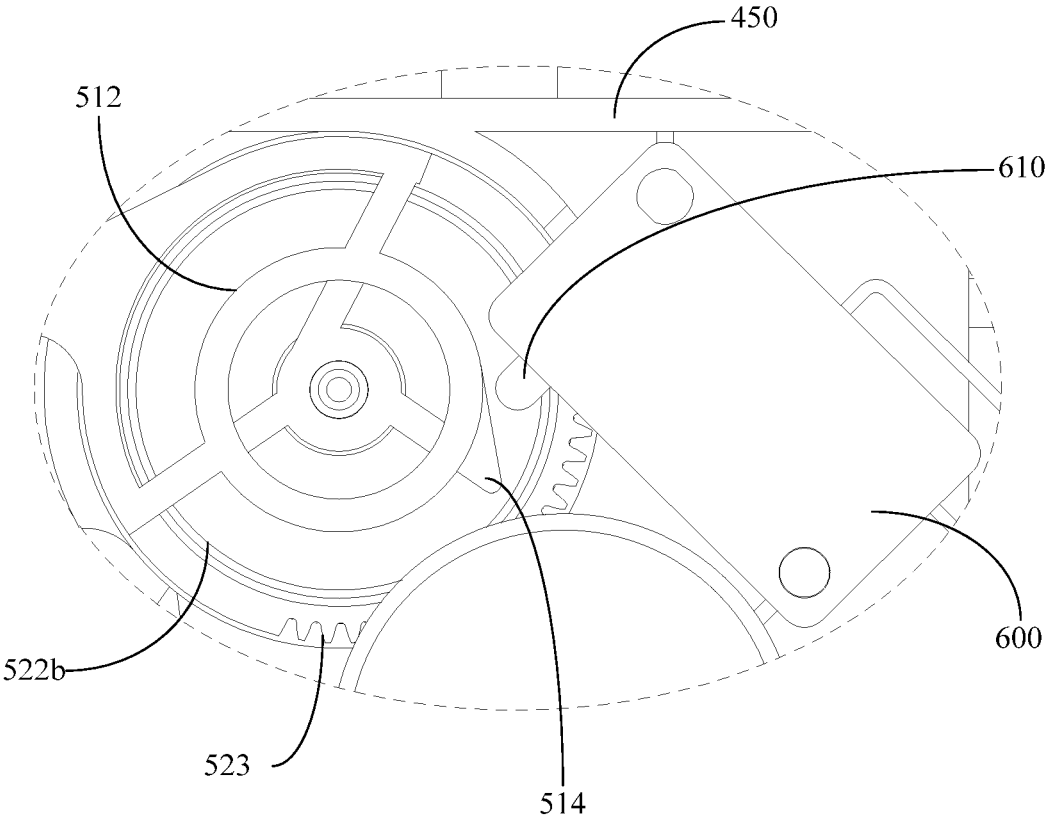
FIG. 7 is a schematic view of an enlarged structure at part C in FIG. 6.

Referring to FIG. 6 and FIG. 7, in an embodiment, the exhaust system 30 further includes a position sensor 600, and the position sensor 600 is disposed at the housing 400. In an exemplary embodiment, the position sensor 600 is disposed in the exhaust channel 410. The position sensor 600 is electrically connected to the controller to be controlled by the controller to operate. The position sensor 600 is configured to, when the adjustment member 510 moves to cover the first air inlet 420, transmit a sensing signal to the controller. In this way, it is possible to better know whether the first gas 901 discharged from the tub 20 enters the exhaust channel 410, and thus an association between an operation state of the exhaust system 30 and an operation state of the tub 20 can realized.

Various exemplary solutions of the position sensor 600 are described below.

In an embodiment, the position sensor 600 may be a non-contact sensor, and may be, but is not limited to, a photoelectric sensor, an image recognition sensor, or the like. In this case, the position sensor 600 is disposed at a movement path of the adjustment member 510, to enable the adjustment member 510 to be captured by the position sensor 600 to trigger the sensing signal when the adjustment member 510 moves to pass through the position sensor 600.

In an embodiment, the position sensor 600 may be a contact sensor, and may be, but is not limited to, a pressure sensor 800, a travel switch, or the like. In this case, the position sensor 600 is disposed at the abutment side 513 or an inner wall of the exhaust channel 410 abutting with the abutment side 513, to enable the position sensor 600 to be abutted to trigger the sensing signal when the adjustment member 510 moves to the first air inlet 420.

As an example, the position sensor 600 is the contact sensor. In an embodiment, the adjustment member 510 includes a plate-shaped body 511 and a mounting disc portion 512 disposed at an end of the plate-shaped body 511. The mounting disc portion 512 is rotatably mounted at the exhaust channel 410. The mounting end is formed by the mounting disc portion 512. The position sensor 600 has an electrical contact 610. The mounting disc portion 512 is provided with a contact protrusion 514 at a side of the mounting disc portion 512 facing towards the electrical contact 610. The contact protrusion 514 is configured to abut with the electrical contact 610 when the adjustment member 510 moves to cover the first air inlet 420.

It can be understood that the mounting disc portion 512 is provided to enhance mounting stability between the adjustment member 510 and the inner wall of the exhaust channel 410, and facilitate an increase of torque of the contact protrusion 514. Therefore, when the adjustment member 510 just covers the first air inlet 420, the contact protrusion 514 just abuts with the electrical contact 610, and a pressing force is applied to the electrical contact 610. In this case, the current state can be captured by the position sensor 600 and form the sensing signal.

Further, in an embodiment, the contact protrusion 514 has a front side close to the electrical contact 610 and a rear side away from the electrical contact 610. Moreover, a front side wall of the contact protrusion 514 may be inclined or formed into an arc shape, to form a guide surface. Therefore, when the contact protrusion 514 moves towards the electrical contact 610, interference is formed between the contact protrusion 514 and the electrical contact 610, and an interference amount gradually increases, i.e., the pressing force applied by the contact protrusion 514 to the electrical contact 610 gradually increases.

In addition, the mounting disc portion 512 is hollowed-out to reduce mass of the adjustment member 510 at the mounting disc portion 512.

Referring to FIG. 2 to FIG. 3, in an embodiment, the first air inlet 420 and the second air inlet 430 are gradually inclined towards each other away from the exhaust channel 410. That is, an angle is formed between a plane where the first air inlet 420 is located and a plane where the second air inlet 430 is located, and an angle between a side of the first air inlet 420 facing towards the exhaust channel 410 and a side of the second air inlet 430 facing towards the exhaust channel 410 is smaller than 180°. In this way, the first gas 901 entering the exhaust channel 410 through the first air inlet 420 gradually flows towards the second gas 902 entering the exhaust channel 410 through the second air inlet 430. Therefore, the first gas 901 and the second gas 902 may be more quickly converged and mixed. Moreover, the drying effect on the first gas 901 is improved.

Based on the above, in order to increase universality of the exhaust system 30 on the dishwashers 1 in different specifications, in an embodiment, the housing 400 has an air guide channel 460. A channel port of the air guide channel 460 at an end of the air guide channel 460 is configured to be connected to the air outlet 21 of the tub 20, and an channel port of the air guide channel 460 at another end of the air guide channel 460 is formed as the first air inlet 420 for the first gas 901 of the tub 20 to enter from the air outlet 21 and to be discharged from the first air inlet 420 to the exhaust channel 410 after passing through the air guide channel 460. The air guide channel 460 extends along a curved path to guide the first gas 901 in the exhaust channel 410 to flow towards the second air inlet 430.

It can be understood that the air guide channel 460 can guide the first gas 901 into the exhaust channel 410 from the first air inlet 420 after diverting the first gas 901 discharged from the air outlet 21 of the tub 20. Therefore, a position design of the first air inlet 420 and a position design of the second air inlet 430 in the exhaust system 30 are not limited by a forming position of the air outlet 21 of the tub 20, which facilitates to improve the universality of the exhaust system 30.

In addition, the housing 400 may also be provided with an air guide structure 470 in the exhaust channel 410. The air guide structure 470 has a plurality of exemplary forms, such as an air guide plate arranged adjacent to the first air inlet 420 and/or the second air inlet 430, or an arc surface section formed at an inner side wall of the exhaust channel 410, to guide the first gas 901 and the second gas 902 to be quickly mixed. Therefore, it is possible to prevent the first gas 901 from be condensed and formed into the condensate water at the inner wall of the exhaust channel 410 due to delayed drying.

With continued reference to FIG. 2 and FIG. 5, in an embodiment, the exhaust system 30 further includes a first fan 700. The first fan 700 is disposed in the exhaust channel 410 and is configured to drive the gas in the exhaust channel 410 to the exhaust outlet 440 to accelerate rapid circulation of the first gas 901, the second gas 902, and the mixed gas 903. The first fan 700 is electrically connected to the controller to be controlled by the controller to operate.

Based on the above embodiments, the controller may control the adjustment mechanism to operate. In some embodiments, when the dishwasher 1 is at the washing stage, the controller may adjust the flow rate of the first gas 901 entering the exhaust channel 410 to be zero by controlling the adjustment mechanism. That is, the adjustment member 510 may be driven to cover the first air inlet 420 to avoid the leakage of the high-temperature and high-humidity steam in the tub 20 and reduce the washing effect; when the dishwasher 1 is at the exhaust stage and there is a large amount of steam, the controller may control the adjustment mechanism to adjust the first gas 901 and the second gas 902 to enter the exhaust channel 410 with a suitable ratio of the first gas 901 to the second gas 902, which allow for enough exhaust amount for the first gas 901, and the second gas 902 can quickly dry the first gas 901 to avoid the generation of the condensate water. When the dishwasher 1 is at the exhaust stage and the amount of steam is reduced to a predetermined value, the controller may adjust the first gas 901 to enter the exhaust channel 410 at a maximum flow rate by controlling the adjustment mechanism, to realize rapid discharge of the first gas 901.

It can be understood that the above control process may be implemented by providing a related program of the controller. For example, based on an exhaust rule of the dishwasher 1, a time period is set to allow the first gas 901 and the second gas 902 to be adjusted to a proper ratio within a predetermined time period after the first air inlet 420 is opened; and after the predetermined time period, the first air inlet 420 is adjusted to be fully opened, allowing for a maximum flow rate of the first gas 901 to be maximum.

Alternatively, referring to FIG. 2 and FIG. 5, in an embodiment, the exhaust system 30 further includes a sensor 800 including a temperature sensing module and a humidity sensing module. The sensor 800 is disposed at the exhaust channel 410 and is configured to sense a temperature and humidity at the exhaust channel 410, respectively. The controller is electrically connected to the sensor 800 to control the adjustment mechanism to operate based on the received temperature and humidity in accordance with the predetermined rule.

It can be understood that the temperature sensing module and the humidity sensing module may be separately arranged to be assembled into a sensing module together to form the sensor 800; or the temperature sensing module and the humidity sensing module may be integrated into one piece to form the sensor 800.

Further, in an embodiment, as described above, when the exhaust system 30 further includes a first fan 700, and the first fan 700 is disposed in the exhaust channel 410 and electrically connected to the controller. The sensor 800 may be arranged upstream or downstream of the first fan 700. That is, the sensor 800 may be arranged at a side away from the exhaust outlet 440 or at a side close to the exhaust outlet 440 as desired.

And/or, the sensor 800 is arranged adjacent to the first fan 700. For example, in practical applications, referring to FIG. 2, the sensor 800 may be arranged downstream of the first fan 700 and close to the first fan 700.

In addition, in an embodiment, the dishwasher 1 further includes a second fan. The second fan is disposed in the tub 20, and configured to drive the circulation of gas in the tub 20 and drive the first gas 901 to enter the exhaust channel 410 more quickly. The second fan is electrically connected to the controller to be controlled by the controller to operate.

And/or, in an embodiment, the dishwasher 1 further includes a heater. The heater is disposed at the tub 20 and may heat the gas in the tub 20 to form the required hot air. The heater is electrically connected to the controller to be controlled by the controller to operate.

In some embodiments, the first air inlet 420 is a steam inlet 420. The second air inlet 430 is an air inlet 430. The first gas 901 may be steam, and the second gas 902 may be air.

The housing 400 has the exhaust channel 410, and a steam inlet 420 and an air inlet 430 that are in communication with the exhaust channel 410. The steam inlet 420 is in communication with the tub 20 of the dishwasher 1 to introduce the steam 901 discharged from the tub 20. The air inlet 430 is configured to introduce an external air 902 with humidity lower than humidity of the steam 901.

The adjustment device 500 includes an adjustment member 510, a drive component 520, and the controller. The adjustment member 510 is movably arranged between the air inlet 430 and the steam inlet 420. The drive component 520 is configured to drive the adjustment member 510 to move between the air inlet 430 and the steam inlet 420, to adjust a flow rate of steam 901 entering the exhaust channel 410 through the steam inlet 420 and/or a flow rate of air 902 entering the exhaust channel 410 through the air inlet 430. The controller is electrically connected to the drive component 520 to control a movement position of the adjustment member 510 between the air inlet 430 and the steam inlet 420 to control a ratio of the steam 901 entering the exhaust channel 410 to the air 902 entering the exhaust channel 410.

In the technical solution of the present disclosure, the controller can control the drive component 520 to operate based on the predetermined rules or actual needs, to realize intelligent operation of the adjustment member 510. The adjustment member 510 can adjust the flow rate of the steam 901 entering the exhaust channel 410 through the steam inlet 420 and/or the flow rate of the external air 902 entering the exhaust channel 410 through the air inlet 430, allowing for an adjustable ratio of the steam 901 at the exhaust channel 410 to the air 902 at the exhaust channel 410. Therefore, it is possible to effectively lower the flow rate of the steam 901 entering the exhaust channel 410 when a large amount of steam 901 is discharged from the tub 20, and introduce sufficient air 902 for the steam 901 to realize rapid drying of the steam 901. When a small amount of steam 901 is discharged from the tub 20, the flow rate of the steam 901 entering the exhaust channel 410 is effectively increased, and drying efficiency of the steam 901 is improved. The adjustment device 500 is provided to allow the steam 901 discharged from the tub 20 to be directly dried, which avoids the formation of the cooling medium at a path where the steam 901 enters the exhaust channel and the generation of the condensate water. According to the technical solutions in the present disclosure, it is possible to effectively enhance the drying efficiency of the steam 901 discharged from the tub 20. Moreover, the generation of the condensate water can be reduced or even eliminated, and the drying effect is optimized.

It can be understood that when the exhaust system 30 is applied in the dishwasher 1, the housing 400 and the shell 10 may be integrally formed, or the housing 400 may be separated from the shell 10. When the housing 400 is separated from the shell 10, a mounting manner between the housing 400 and the shell 10 is not limited. For example, the housing 400 and the shell 10 may be screwed and fixed by means of a threaded fit between a threaded member and a threaded hole, may be fastened and fixed by a snap-fit between a snap member and a mating snap member, or may be adsorbed and fixed by means of adsorption and cooperation of the adsorption member and a mating adsorption member.

Figure 9:
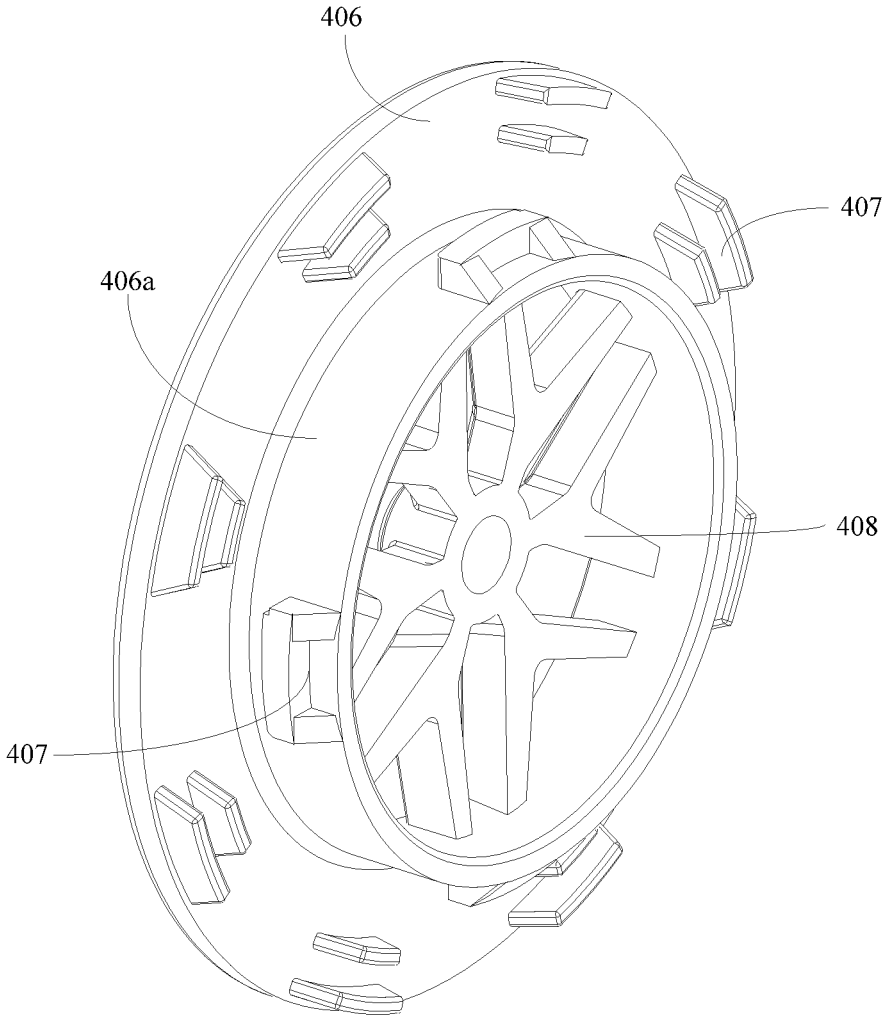
FIG. 9 is a schematic structural view of a fixed base in FIG. 2.

The housing 400 may be directly fixed and mounted at the shell 10, or may be fixed and mounted at the shell 10 through an additional mounting structure. As illustrated in FIG. 2 and FIG. 9, in an embodiment, the exhaust system 30 further includes a fixed base 406. The fixed base 406 is substantially disk-shaped and is disposed between the shell 10 and the housing 400. The fixed base 406 is screwed and fixed at the shell 10 by screws. A boss 406*a* is provided at a side of the fixed base 406 facing towards the housing 400, and protrudes from the side of the fixed base 406 facing towards the housing 400. A groove (not shown) is defined at the housing 400 corresponding to the boss 406*a*. Through a concave-convex fit between the boss 406*a* and the groove, accurate positioning of the housing 400 at the shell 10 can be realized.

Then, the fixed base 406 may be provided with an engagement member (not shown) at one of an outer peripheral side of the boss 406*a* and an inner peripheral side of the groove, and the engagement member protrudes from the one of the outer peripheral side of the boss 406*a* and the inner peripheral side of the groove. Further, an engagement groove 407 is formed at another one of the outer peripheral side of the boss 406*a* and the inner peripheral side of the groove. Through an engagement between the engagement member and the engagement groove 407, the housing 400 can be detachably mounted at the shell 10. Further, it is convenient for disassembling. As an example, the engagement groove 407 is provided at the outer peripheral side of the boss 406*a*. In this example, a plurality of engagement grooves 407 may be provided at the outer peripheral side of the boss 406*a*, and is arranged at intervals in a circumferential direction of the boss 406*a*.

The fixed base 406 may further be provided with a plurality of reinforcement ribs 408 at a threaded connection of the screw. The plurality of reinforcement ribs 408 is conducive to enhancing a connection strength at the threaded connection. Therefore, installation and stabilization of the exhaust system 30 on the shell 10 can be facilitated.

The steam inlet 420 of the housing 400 is formed adjacent to the air inlet 430 to facilitate rapid mixing of the steam 901 with the air 902. The steam 901 as described above generally refers to the high-temperature and high-humidity steam 901 discharged through the air outlet 21 of the tub 20. The air 902 may be any gas drier than the steam 901. The air 902 may be an indoor air directly introduced, or a dry gas specially introduced from other parts of the dishwasher 1 or from the external device. Since the air 902 is drier than the steam 901, when the steam 901 is mixed with the air 902, the mixed gas 903 neutralizes the humidity of the steam 901 and the humidity of the air 902 to achieve the purpose of fast drying.

An airflow area of the steam inlet 420 and an airflow area of the air inlet 430 may be set to be substantially the same or different based on actual application requirements.

The housing 400 is generally further has the exhaust outlet 440 in communication with the exhaust channel 410, to discharge the mixed gas 903 by mixing the steam 901 with the air 902. In some embodiments, the steam inlet 420 and the air inlet 430 are adjacent to each other and arranged at one end of the exhaust channel 410, and the exhaust outlet 440 may be disposed at another end of the exhaust channel 410 to appropriately prolong the flow path of the mixed gas 903. Therefore, it is possible to achieve sufficient drying of the steam 901 by the air 902.

The adjustment device 500 acts on the at least one of the steam inlet 420 and the air inlet 430 to control the flow rate of the steam 901 and the flow rate of the air 902 by changing the airflow area of the steam inlet 420 and/or the airflow area of the air inlet 430. Therefore, the ratio of the steam 901 at the exhaust channel 410 to the air 902 at the exhaust channel 410 is adjustable.

In some embodiments, the adjustment member 510 is movable between the steam inlet 420 and the air inlet 430 to change the airflow area of the steam inlet 420 and/or the airflow area of the air inlet 430, to control the flow rate of the steam 901 and the flow rate of the air 902. Therefore, the ratio of the steam 901 at the exhaust channel 410 to the air 902 at the exhaust channel 410 is adjustable.

At least two adjustment members 510 may be provided. The two adjustment members 510 are respectively disposed at the steam inlet 420 and the air inlet 430, to independently adjust a flow rate at the steam inlet 420 and a flow rate at the air inlet 430.

One adjustment member 510 may also be provided. Adjustment on the flow rate at the steam inlet 420 and the flow rate of the air inlet 430 may be simultaneously realized by the one adjustment member 510.

By arranging the adjustment member 510 and the drive component 520, the adjustment of the adjustment device 500 on the flow rate of the steam 901 entering the exhaust channel 410 through the steam inlet 420 and/or on the flow rate of the air 902 entering the exhaust channel 410 through the air inlet 430 can be set as stepped adjustment or stepless adjustment as desired.

Under the driving of the drive component 520, the adjustment member 510 may move towards the steam inlet 420 to cover the steam inlet 420, and move towards the air inlet 430 to cover the air inlet 430.

A plurality of exemplary solutions of the adjustment device 500 for implementing the foregoing functions will be described below.

In an embodiment, the adjustment member 510 is translatably arranged between the steam inlet 420 and the air inlet 430, to allow the adjustment member 510 to translate towards the steam inlet 420 to cover the steam inlet 420 and translate towards the air inlet 430 to cover the air inlet 430 when driven by the drive component 520.

It can be understood that the translation may be along the straight line. For example, the adjustment member 510 is translatably arranged in a direction of a connection line between the steam inlet 420 and the air inlet 430, to shorten the translation path of the adjustment member 510. The translation may also be along a curve line, to change a shielding direction of the adjustment member 510 on the steam inlet 420 and/or the air inlet 430. Therefore, it is helpful to refine a shielding variable of the adjustment member 510 on the steam inlet 420 and/or the air inlet 430, and improve an adjustment precision of the ratio of the steam 901 to the air 902.

In an embodiment, when the housing 400 has a connection wall 450 located between the steam inlet 420 and the air inlet 430, the adjustment member 510 is mounted on the connection wall 450, and the connection wall 450 is rotatably arranged. In some embodiments, the adjustment member 510 has a mounting end and a free end opposite to the mounting end. The mounting end is movably connected to the connection wall 450. The free end of the adjustment member 510, when driven by the drive component 520, rotates towards the steam inlet 420 to enable the adjustment member 510 to cover the steam inlet 420 and rotates towards the air inlet 430 to enable the adjustment member 510 to cover the air inlet 430. The adjustment member 510 is constructed in a generally plate-like shape, or at least has a plate surface facing towards the steam inlet 420 and a plate surface facing towards the air inlet 430.

Referring to FIG. 2 to FIG. 4, the mounting end of the adjustment member 510 may be configured to be rotatable along the rotation axis extending in a direction substantially parallel to the connection wall 450, to allow the plate surface of the adjustment member 510 to rotate relative to the plane where the connection wall 450 is located. In this way, an air flowing cavity for the steam 901 and/or the air 902 can be formed by enclosing the adjustment member 510 and an inner wall of the exhaust channel 410 at an opposite side during the rotation of the adjustment member 510. The air flowing cavity is flared in an airflow direction. Therefore, it facilitates sufficient diffusion of the steam 901 and/or the air 902 during their flow, aiding in rapid mixing of the steam 901 and the air 902.

Next, in an embodiment, the drive component 520 includes a driver disposed at the housing 400 and a transmission mechanism. The transmission mechanism connects the driver and the adjustment member 510. It should be noted that the driver may be constructed with a rotary output shaft or an extendable output shaft based on a movable manner of the adjustment member 510. The transmission mechanism is connected to the driver and the adjustment member 510 to transmit power of the driver to the adjustment member 510.

Rotary mounting of the adjustment member 510 is taken as an example. For example, in an embodiment, the drive component 520 may only include the drive motor 521. The drive motor 521 is in a direct drive connection with the mounting end, or is in a drive connection with the mounting end through a structure such as a coupler, to drive the mounting end to rotate. In an embodiment, the drive component 520 may only include a wax motor. The transmission mechanism may be a link mechanism, a lever mechanism, an electromagnetic transmission mechanism, etc., and the description thereof in detail will be omitted herein for brevity.

As illustrated in the above embodiments, the adjustment member 510 has the mounting end. When the mounting end is rotatably mounted at the connection wall 450, referring to FIG. 6 to FIG. 8, the drive component 520 includes a drive motor 521 and two rotary portions 522. The drive motor 521 is mounted at the housing 400. In an exemplary embodiment, the drive motor 521 is fixed and mounted in the exhaust channel 410. The drive motor 521 is electrically connected to the controller to be controlled by the controller to operate. Two rotary portions 522 are parallel to each other and mounted rotatably at the exhaust channel 410. One of the two rotary portions 522 is connected to the drive motor 521, and another one of the two rotary portions 522 is connected to the mounting end. The two rotary portions 522 are provide with teeth 523 at sides of the two rotary portions 522 facing towards each other, and the teeth 523 are engaged with each other. It can be understood that each of the two rotary portions 522 is of a generally disc shape, and the teeth 523 are provided at a side of the disc. In this way, the two rotary portions 522, when driven by the drive motor 521, perform transmission through the teeth 523 engaged with each other to drive the mounting end to rotate.

The rotary portion 522 connected to the drive motor 521 is defined as the driving rotary portion 522*a*, and the rotary portion 522 connected to the mounting end of the adjustment member 510 is the driven rotary portion 522*b*. In an embodiment, at least one of the driving rotary portion 522*a* and the driven rotary portion 522*b* may be arranged at the corresponding drive motor 521 and/or the corresponding adjustment member 510. Taking the driven rotary portion 522*b* as an example, the mounting end of the adjustment member 510 has an arc-shaped surface at a side facing away from the free end of the adjustment member 510, and the teeth 523 are disposed at the arc-shaped surface. The teeth 523 may at least partially extend and be distributed at the arc-shaped surface, and the driven rotary portion 522*b* is arranged at the arc-shaped surface.

In another embodiment, at least one of the driving rotary portion 522*a* and the driven rotary portion 522*b* may be configured as a separate member and is independently disposed from the corresponding drive motor 521 and/or the adjustment member 510. For example, the at least one of the driving rotary portion 522*a* and the driven rotary portion 522*b* may be configured as a gear structure. The driving rotary portion 522*a* and the driven rotary portion 522*b* have their own rotation axes spaced apart from or arranged in parallel, allowing for better engagement and transmission between the driving rotary portion 522*a* and the driven rotary portion 522*b*.

In an embodiment, the adjustment member 510 includes a plate-shaped body 511 and a mounting disc portion 512 disposed at an end of the plate-shaped body 511. The mounting disc portion 512 is rotatably connected to a side wall of the exhaust channel 410. The plate-shaped body 511 is movably arranged between the steam inlet 420 and the air inlet 430. Due to the arrangement of the mounting disc portion 512, the mounting stability between the adjustment member 510 and the inner wall of the exhaust channel 410 can be enhanced. The drive component 520 is connected to the mounting disc portion 512.

It can be understood that the housing 400 includes a first cavity casing 400*a* forming the steam inlet 420 and a second cavity casing 400*b* forming the air inlet 430. Two opposite side plate surfaces of the plate-shaped body 511 face towards the first cavity casing 400*a* and the second cavity casing 400*b*. A middle part of the mounting disc portion 512 is rotatably mounted at a channel wall of the exhaust channel 410 at a position where the mounting disc portion 512 is located. A plate surface of the mounting disc portion 512 matches with the channel wall of the exhaust channel 410 at the position where the mounting disc portion 512 is located. The mounting disc portion 512 may be hollowed out to reduce the mass of the adjustment member 510 at the mounting disc portion 512.

The drive component 520 drives the mounting disc portion 512 to rotate, to drive the plate-shaped body 511 to rotate between the steam inlet 420 and the air inlet 430.

In some embodiments, as described above, the rotary portion 522 connected to the drive motor 521 is defined as the driving rotary portion 522*a*, and the rotary portion 522 connected to the mounting end of the adjustment member 510 is defined as the driven rotary portion 522*b*. The driving rotary portion 522*a* is coaxially mounted on the mounting disc portion 512 and is restricted between the mounting disc portion 512 and a side wall of the exhaust channel 410 at the position where the mounting disc portion 512 is located, which allows for more stable mounting and rotation of the driven rotary portion 522*b*.

In an embodiment, the adjustment member 510 includes a plate-shaped body 511 and a mounting disc portion 512 disposed at the end of the plate-shaped body 511. The mounting disc portion 512 is rotatably mounted in the exhaust channel 410, and the mounting end is formed by the mounting disc portion 512.

In an embodiment, the adjustment device 500 further includes a limit structure. That is, the exhaust system 30 further includes a limit structure. The limit structure is configured to limit the adjustment member 510 onto a housing 400 when the adjustment member 510 moves to cover the steam inlet 420 and/or when the adjustment member 510 moves to cover the air inlet 430.

In some embodiments, the adjustment member 510 has a first plate surface for covering the steam inlet 420, and the limit structure is configured to connect the first plate surface and the housing 400 when the adjustment member 510 moves to cover the steam inlet 420, to prevent the adjustment member 510 from rebounding due to abutting of the adjustment member 510 with the housing 400, which may affect the effect of covering the steam inlet 420 with the first plate; and/or the adjustment member 510 has a second plate surface for covering the air inlet 430, and the limit structure is configured to connect the second plate surface and the housing 400 when the adjustment member 510 moves to cover the air inlet 430, to prevent the adjustment member 510 from rebounding due to the abutting of the adjustment member 510 with the housing 400, which may affect the effect of covering the air inlet 430 with the second plate.

It can be understood that when two limit structures may be provided and are respectively disposed between the first plate surface and the inner wall of the corresponding exhaust channel 410 and between the second plate surface and the inner wall of the corresponding exhaust channel 410, the two limit structures may be constructed to be the same as or different from each other.

A plurality of exemplary solutions for the limit structure may be provided. As an example, the limit structure is disposed between the first plate surface and the inner wall of the corresponding exhaust channel 410. The limit structure may include the connection portion disposed at the first plate surface and the connection mating portion disposed at the inner wall of the corresponding exhaust channel 410.

In an embodiment, the connection portion may be an adsorption member, and the mating connection portion is a mating adsorption member. The connection between the first plate surface and the inner wall of the corresponding exhaust channel 410 is achieved through the adsorption effect when the adsorption member and the mating adsorption member move close to each other. The adsorption member may be a suction cup, a magnetic structure, or the like.

In an embodiment, the connection portion may be an adhesive member, and the mating connection portion is a mating adhesive member. The connection between the first plate surface and the inner wall of the corresponding exhaust channel 410 is achieved through the adhesive effect when the adhesive member and the mating adhesive member move close to each other. The adhesive member may be an adhesive tape suitable for the current environment, or the like.

In an embodiment, the connection portion may be a fastener, and the mating connection portion is a mating fastener member. The connection between the first plate surface and the inner wall of the corresponding exhaust channel 410 is achieved through the fastening effect when the fastener and the mating fastener member moves close to each other.

When the drive component 520 includes the driving rotary portion 522*a* and the driven rotary portion 522*b* as described above, the teeth 523 located between the driving rotary portion 522*a* and the driven rotary portion 522*b* and engaged with each other can realize a self-locking of a movement state of the driving rotary portion 522*a* and a movement state of the driven rotary portion 522*b* when the driving rotary portion 522*a* and the driven rotary portion 522*b* do not rotate. In this way, self-locking of a movement state of the adjustment member 510 can be realized. Moreover, a purpose of preventing the adjustment member 510 from rebounding is attained. Therefore, the limit structure is formed by the driving rotary portion 522*a* and the driven rotary portion 522*b* together.

Referring to FIG. 6 and FIG. 8, in an embodiment, the adjustment member 510 is constructed in a plate-like shape, and has an abutment side 513 facing towards the steam inlet 420 and/or an abutment side 513 facing towards the air inlet 430. That is, a side where the first plate surface and/or the second plate surface is located is formed as the abutment side 513. An elastic seal layer 513*a* is at least disposed at the abutment side 513 of the adjustment member 510. As an example, the elastic seal layer 513*a* is disposed at the first plate surface. On one hand, the elastic seal layer 513*a* may seal a gap between the first plate surface and a peripheral side of the steam inlet 420 when the first plate surface covers the steam inlet 420, to avoid leakage of the steam 901; on the other hand, the elastic seal layer 513*a* may relieve a mutual impact between the first plate surface and the peripheral side of the steam inlet 420 when the first plate surface covers the steam inlet 420, to achieve a damping effect, which is helpful to eliminate collision noise and improve a service life of each of the adjustment member 510 and the housing 400.

The elastic seal layer 513*a* may be made of elastic materials such as rubber and silica gel. The elastic seal layer 513*a* and the adjustment member 510 may be integrally formed. For example, the first plate surface of the adjustment member 510 is at least made of an elastic material; or the elastic seal layer 513*a* and the adjustment member 510 are separately arranged and then are detachably connected to each other. The elastic seal layer 513*a* may be expanded on the entire first plate surface, or may correspond to a connection between the first plate surface and the housing 400.

Further, in an embodiment, a protrusion 513*b* is disposed in a middle of the abutment side 513 of the adjustment member 510. A shape and size of the protrusion 513*b* are adapted to the corresponding steam inlet 420 or the corresponding air inlet 430. The protrusion 513*b* is configured to be caught into the steam inlet 420 when the adjustment member 510 moves to cover the steam inlet 420, and/or caught into the air inlet 430 when the adjustment member 510 moves to cover the air inlet 430.

Similarly, taking the protrusion 513*b* disposed at the first plate surface as an example, the protrusion 513*b* is configured to be caught into the steam inlet 420 when the first plate surface covers the steam inlet 420, which can increase the effect of coving the steam inlet 420 with the first plate surface, and is equivalent to forming the limit structure to facilitate the stable connection between the adjustment member 510 and the housing 400; when the protrusion 513*b* is caught into the steam inlet 420, an outer side surface of the protrusion 513*b* matches with a shape of an outer surface of the housing 400 at a position where the protrusion 513*b* is located, to avoid an unnecessary recess structure from being formed at the outer surface of the housing 400, which facilitates to improve the aesthetics of the whole machine.

Similarly, the protrusion 513*b* and the abutment side 513 may be integrally formed, or the protrusion 513*b* may be separated from the abutment side 513. When the abutment side 513 is provided with the elastic seal layer 513*a* and/or the protrusion 513*b*, the elastic seal layer 513*a* may be spread at the whole plate surface of the abutment side 513 and is sandwiched between the protrusion 513*b* and the abutment side 513; or the elastic seal layer 513*a* is arranged around a peripheral side of the protrusion 513*b*.

Further, a peripheral side wall of the protrusion 513*b* may be at least elastic, to enable the protrusion 513*b* to correspondingly elastically abut with an inner edge of the steam inlet 420 or an inner edge of the air inlet 430 when the protrusion 513*b* is caught into in the steam inlet 420 or the air inlet 430, to further enhance sealing effect and connection strength.

In addition, in an embodiment, the adjustment member 510 is provided with a guide portion. The guide portion is movably connected to an engagement portion 480 disposed at the exhaust channel 410, to guide the adjustment member 510 to move between the steam inlet 420 and the air inlet 430. The arrangement of the guide portion and the engagement portion 480 can define an accurate path for the movement of the adjustment member 510 and prevent the adjustment member 510 from being laterally deviated and disengaged during its movement.

In some embodiments, the guide portion is configured as a slid protrusion slidably connected to the engagement portion 480 constructed as a slid groove. An extending direction of the slid protrusion is adapted to a moving direction of the adjustment member 510. For example, when the adjustment member 510 enables reciprocating rotation between the steam inlet 420 and the air inlet 430, the slid protrusion is generally of an arc shape.

With continued reference to FIG. 6 and FIG. 7, in an embodiment, the adjustment device 500 further includes a position sensor 600, and the position sensor 600 is disposed at the housing 400. In an exemplary embodiment, the position sensor 600 is disposed in the exhaust channel 410. The position sensor 600 is electrically connected to the controller to be controlled by the controller to operate. The position sensor 600 is configured to sense position information of the adjustment member 510. For example, when the adjustment member 510 moves to cover the steam inlet 420, the position sensor 600 transmits a sensing signal to the controller. In this way, it is possible to better know whether the steam 901 discharged from the tub 20 enters the exhaust channel 410, and thus an association between an operation state of the exhaust system 30 and an operation state of the tub 20 can realized.

Various exemplary solutions of the position sensor 600 are described below.

In an embodiment, the position sensor 600 may be a non-contact sensor such as a photoelectric sensor, an image recognition sensor, or the like. In this case, the position sensor 600 is disposed at a movement path of the adjustment member 510, to enable the adjustment member 510 to be captured by the position sensor 600 to trigger the sensing signal when the adjustment member 510 moves to pass through the position sensor 600.

In an embodiment, the position sensor 600 may be a contact sensor such as a pressure sensor, a travel switch, or the like. In this case, the position sensor 600 is disposed at the abutment side 513 or an inner wall of the exhaust channel 410 abutting with the abutment side 513, to enable the position sensor 600 to be abutted to trigger the sensing signal when the adjustment member 510 moves to the steam inlet 420.

As an example, the position sensor 600 is the contact sensor. In an embodiment, the adjustment member 510 includes a plate-shaped body 511 and a mounting disc portion 512 disposed at an end of the plate-shaped body 511. The mounting disc portion 512 is rotatably mounted at the exhaust channel 410. The mounting end is formed by the mounting disc portion 512. The position sensor 600 has an electrical contact 610. The mounting disc portion 512 is provided with a contact protrusion 514 at a side of the mounting disc portion 512 facing towards the electrical contact 610. The contact protrusion 514 is configured to abut with the electrical contact 610 when the adjustment member 510 moves to cover the steam inlet 420.

It can be understood that the mounting disc portion 512 is provided to enhance mounting stability between the adjustment member 510 and the inner wall of the exhaust channel 410, and facilitate an increase of torque of the contact protrusion 514. Therefore, when the adjustment member 510 just covers the steam inlet 420, the contact protrusion 514 just abuts with the electrical contact 610, and a pressing force is applied to the electrical contact 610. In this case, the current state can be captured by the position sensor 600 and form the sensing signal.

Further, in an embodiment, the contact protrusion 514 has a front side close to the electrical contact 610 and a rear side away from the electrical contact 610. Moreover, a front side wall of the contact protrusion 514 may be inclined or formed into an arc shape, to form a guide surface. Therefore, when the contact protrusion 514 moves towards the electrical contact 610, interference is formed between the contact protrusion 514 and the electrical contact 610, and an interference amount gradually increases, i.e., the pressing force applied by the contact protrusion 514 to the electrical contact 610 gradually increases.

And/or, referring to FIG. 2 and FIG. 5, in an embodiment, the exhaust system 30 further includes a sensor 800 including a temperature sensing module and a humidity sensing module. The sensor 800 is disposed at the exhaust channel 410 and is configured to sense a temperature and humidity at the exhaust channel 410, respectively. The controller is electrically connected to the sensor 800 to control the adjustment mechanism to operate based on the received temperature and humidity in accordance with the predetermined rule.

It can be understood that the temperature sensing module and the humidity sensing module may be separately arranged to be assembled into a sensing module together to form the sensor 800; or the temperature sensing module and the humidity sensing module may be integrated into one piece to form the sensor 800.

In addition, the present disclosure further provides an exhaust system 30. The exhaust system 30 includes the housing 400 and the adjustment device 500 as described above. It should be noted that, for a detailed structure of the adjustment device 500 in the exhaust system 30, reference may be made to the embodiments of the adjustment device 500, and details thereof will be omitted herein for brevity. Since the adjustment device 500 is applied in the exhaust system 30 of the present disclosure, the embodiments of the exhaust system 30 of the present disclosure include all the technical solutions of all embodiments of the adjustment device 500, and the technical effects achieved are also completely the same, which will not be described in detail herein.

In an embodiment, the housing 400 includes a first cavity casing having the steam inlet 420 and a second cavity casing having the air inlet 430. The first cavity casing is connected to the second cavity casing in a bending manner to define the mixing channel section between the first cavity casing and the second cavity casing.

In some embodiments, referring to FIG. 2 and FIG. 3, the first cavity casing and the second cavity casing are gradually inclined towards each other away from the exhaust channel 410 That is, an angle is formed between the first cavity casing and the second cavity casing, and an angle between a side of the first cavity casing facing towards the exhaust channel 410 and a side of the second cavity casing facing towards the exhaust channel 410 is smaller than 180°. In this way, the steam 901 entering the exhaust channel 410 through the steam inlet 420 gradually flows towards the air 902 entering the exhaust channel 410 through the air inlet 430. Therefore, the steam 901 and the air 902 may be more quickly converged and mixed. Moreover, the drying effect on the steam 901 is improved.

In addition, the present disclosure provides an air duct structure. The air duct structure is applied in the exhaust system of the dishwasher. The dishwasher may be used to clean tableware, cookware, knives, and the like. Referring to FIG. 1 to FIG. 9, the accompanying drawings illustrate exemplary embodiments where the air duct structure according to the present disclosure is applied in the exhaust system 30 of the dishwasher 1.

Referring to FIG. 5, the exhaust system 30 according to the present disclosure includes an air duct structure and an adjustment device 500. The exhaust system 30 further includes the adjustment device 500. The air duct structure includes a housing 400. The exhaust channel 410 is formed in the housing 400. The exhaust channel 410 includes a mixing channel section 410*a* and an air outlet channel section 410*b* that are in sequential communication with each other. The mixing channel section 410*a* has the steam inlet 420 and the air inlet 430. The steam inlet 420 is in communication with the tub 20 of the dishwasher 1. The air inlet 430 is configured to introduce external air.

The adjustment device 500 is mounted at the mixing channel section 410*a* for adjusting a flow rate of steam 901 entering the exhaust channel 410 through the steam inlet 420 and/or a flow rate of air 902 entering the exhaust channel 410 through the air inlet 430, to control a ratio of the steam 901 entering the exhaust channel 410 to the air 902 entering the exhaust channel 410.

In the technical solution in the present disclosure, the adjustment device 500 can adjust the flow rate of the steam 901 entering the exhaust channel 410 from the steam inlet 420 and/or the flow rate of the external air 902 entering the exhaust channel 410 from the air inlet 430, allowing for an adjustable ratio of the steam 901 at the exhaust channel 410 to the air 902 at the exhaust channel 410. Therefore, it is possible to effectively lower the flow rate of the steam 901 entering the exhaust channel 410 when a large amount of steam 901 is discharged from the tub 20, and introduce sufficient air 902 for the steam 901 to realize the rapid drying of the steam 901. When a small amount of steam 901 is discharged from the tub 20, the flow rate of the steam 901 entering the exhaust channel 410 is effectively increased, and the drying efficiency of the steam 901 is improved. The steam inlet 420 and the air inlet 430 are in direct communication with the mixing channel section 410*a*, which enables the steam 901 discharged from the tub 20 to be directly dried, and avoids the generation of the condensate water due to formation of the cooling medium on a path where the steam 901 enters the exhaust channel. According to the technical solutions in the present disclosure, it is possible to effectively enhance the drying efficiency of the steam 901 discharged from the tub 20. Moreover, the generation of the condensate water can be reduced or even eliminated, and the drying effect is optimized.

The steam inlet 420 of the housing 400 is arranged adjacent to the air inlet 430, to define the mixing channel section 410*a* to facilitate the rapid mixing of the steam 901 with the air 902 within the mixing channel section 410*a*.

The housing 400 also generally has an exhaust outlet 440. The exhaust outlet 440 is in communication with the air outlet channel section 410*b* to discharge the mixed gas 903 obtained by mixing the steam 901 with the air 902. In some embodiments, the steam inlet 420 and the air inlet 430 are adjacent to each other and arranged at an end of the mixing channel section 410*a* away from the air outlet channel section 410*b*, and the exhaust outlet 440 may be disposed at an end of the air outlet channel section 410*b* away from the mixing channel section 410*a* to appropriately prolong the flow path of the mixed gas 903. Therefore, it is possible to achieve sufficient drying of the steam 901 by the air 902.

An extending direction of the exhaust channel 410 relative to the shell 10 is not limited. The exhaust channel 410 may extend in a horizontal direction, in an up-down direction, or in any other directions. When the exhaust channel 410 extends in the up-down direction, the mixing channel section 410*a* is in communication with the air outlet channel section 410*b* from top to bottom, which facilitates to accelerate a discharge speed of the mixed gas 903 to some extent.

Referring to FIG. 2 to FIG. 3, in an embodiment, the housing 400 includes a first cavity casing 400*a* having the steam inlet 420 and a second cavity casing 400*b* having the air inlet. The first cavity casing 400*a* is connected to the second cavity casing 400*b* in a bending manner to define the mixing channel section 410*a* between the first cavity casing 400*a* and the second cavity casing 400*b*. In this way, the steam 901 entering the exhaust channel 410 through the steam inlet 420 and the air 902 entering the exhaust channel 410 through the air inlet 430 may be uniformly mixed in the mixing channel section 410*a* along the bending connection or after circulation.

In some embodiments, an angle is formed between a side of the first cavity casing 400*a* facing towards the mixing channel section 410*a* and a side of the second cavity casing 400*b* facing towards the mixing channel section 410*a*. The angle is smaller than 180°. That is, the first cavity casing 400*a* and the second cavity casing 40*b* are gradually inclined towards each other away from the exhaust channel 410, to enable the steam 901 entering the exhaust channel 410 through the steam inlet 420 to gradually flow towards the air 902 entering the exhaust channel 410 through the air inlet 430. Therefore, the steam 901 and the air 902 may be more quickly converged and mixed in the mixing channel section 410*a*, and the drying effect on the steam 901 is improved.

With continued reference to FIG. 2, FIG. 3, and FIG. 5, in an embodiment, an outer wall of the housing 400 is recessed inwards to form a bump 460' in the exhaust channel 410. An outer side of the bump 460' is configured to cover an air outlet of the tub 20, and the steam inlet 420 is formed at a side wall of the bump 460'. In this way, universality of the air duct structure on the dishwashers 1 in different specifications may be increased. It can be understood that after the steam 901 discharged from the air outlet 21 of the tub 20 is diverted by the bump 460', the steam 901 is guided by the bump 460' to enter the air exhaust channel 410 through the steam inlet 420. Therefore, the position design of the steam inlet 420 and the air inlet 430 in the exhaust system 30 is not limited by the forming position of the air outlet 21 of the tub 20, which facilitates to improve the universality of the air duct structure.

Further, in an embodiment, the side wall of the bump 460' is at least partially formed into an arc shape. This arc-shaped arrangement may smoothly guide the steam 901 passing through the bump 460', enabling the steam 901 to enter the steam inlet 420 more smoothly.

In addition, the housing 400 may also be provided with an air guide structure 470 in the exhaust channel 410. The air guide structure 470 has a plurality of exemplary forms, such as an air guide plate arranged adjacent to the steam inlet 420 and/or the air inlet 430, or the arc surface section formed at the inner side wall of the exhaust channel 410, to guide the steam 901 and the gas 902 to be quickly mixed. Therefore, it is possible to prevent the steam 901 from condensing and generating condensate water at the inner wall of the exhaust channel 410 due to delayed drying.

In an embodiment, the housing 400 includes a first housing 401 and a second housing 402. The mixing channel section 410*a* is formed at the first housing 401. The air outlet channel section 410*b* is at least partially formed at the second housing 402. The first housing 401 is detachably connected to the second housing 402.

It can be understood that the mixing channel section 410*a* is formed at the first housing 401. The steam inlet 420 and the air inlet 430 are formed at an end of the first housing 401 away from the second housing 402, which enables the steam 901 entering the exhaust channel 410 through the steam inlet 420 to be quickly mixed with the air 902 entering the exhaust channel 410 through the air inlet 430 in the mixing channel section 410*a*.

A part of the air outlet channel section 410*b* is formed at the first housing 401, and the rest of the air outlet channel section 410*b* is formed at the second housing 402, which enables a length of the mixing channel section 410*a* to be as shorter as possible. Therefore, the steam 901 can be quickly mixed and dried after entering the mixing channel section 410*a*, to achieve the purpose of no condensate water generation.

Further, in an embodiment, a connection between the mixing channel section 410*a* and the air outlet channel section 410*b* is at least partially in an arc transition. A smooth guide surface may be formed at the arc transition. After the steam 901 in the mixing channel section 410*a* and the air 902 in the mixing channel section 410*a* are guided to be mixed with each other, the mixture can smoothly enter the air outlet channel section 410*b*. Moreover, intense collision between the gas and the inner wall of the exhaust channel 410 can avoided, which may result in noise.

In addition, in view of the above, the present disclosure further provides an exhaust system 30. The exhaust system 30 includes the air duct structure and the adjustment device 500 as described above. The adjustment device 500 is mounted in the mixing channel section 410*a* to adjust the flow rate of the steam 901 entering the exhaust channel 410 through the steam inlet 420, and/or the flow rate of the air 902 entering the exhaust channel 410 through the air inlet 430, to control the ratio of the steam 901 entering the exhaust channel 410 to the air 902 entering the exhaust channel 410.

It should be noted that a detailed structure of the air duct structure in the exhaust system 30 may refer to the embodiments of the air duct structure, and details thereof will be omitted herein for brevity. Since the air duct structure is applied in the exhaust system 30 of the present disclosure, the embodiments of the exhaust system 30 of the present disclosure include all the technical solutions of all embodiments of the air duct structure, and the technical effects achieved are also exactly the same, and thus the description thereof in detail will be omitted herein for brevity.

In some embodiments, the mounting end of the adjustment member 510 may be rotatably disposed along a rotation axis extending in a direction substantially perpendicular to the connection wall 450, to allow the plate surfaces of the adjustment member 510 to substantially slide along the plane where the connection wall 450 is located. In this case, one free end may be provided to separately shield the first air inlet 420 or the second air inlet 430 during each rotation; or two free ends may be provided, are located on two opposite sides of the mounting end respectively, and are of a general blade shape.

Alternatively, referring to FIG. 2 and FIG. 3, the mounting end of the adjustment member 510 may be rotatably disposed along a rotation axis extending in a direction substantially parallel to the connection wall 450, to allow the plate surfaces of the adjustment member 510 to rotate relative to the plane where the connection wall 450 is located. In this way, the mixing channel section 410*a* for the steam 901 and/or the air 902 can be formed by enclosing the adjustment member 510 and an inner wall of the exhaust channel 410 at an opposite side during the rotation of the adjustment member 510. The mixing channel section 410*a* is flared in an airflow direction. Therefore, it facilitates sufficient diffusion of the steam 901 and/or the gas 902 during their flow, aiding in rapid mixing of the steam 901 with the air 902.

Further, in an embodiment, as described above, the adjustment member 510 has a mounting end and a free end opposite to the mounting end. The mounting end is rotatably connected between the steam inlet 420 and the air inlet 430, and the free end faces towards and is located close to a communication between the mixing channel section 410*a* and the air outlet channel section 410*b*. In this way, the length of the mixing channel section 410*a* can be shortened as much as possible, enabling the steam 901 entering the exhaust channel 410 through the steam inlet 420 and the air 902 entering the exhaust channel 410 through the air inlet 430 to be mixed and quickly dried after passing through the adjustment member 510. Therefore, it is possible to achieve the purpose of no condensate water generation.

In addition, the present disclosure further provides a dishwasher 1. As described above, the dishwasher 1 includes a shell 10, a tub 20, and an exhaust system 30. It should be noted that, for a detailed structure of the exhaust system 30 in the dishwasher 1, reference may be made to the above embodiments of the exhaust system 30, and details thereof will be omitted herein for brevity. Since the exhaust system 30 is applied in the dishwasher 1 of the present disclosure, the embodiments of the dishwasher 1 of the present disclosure include all the technical solutions of all the embodiments of the exhaust system 30, and the achieved technical effects are also exactly same, and thus the description thereof in detail will be omitted herein for brevity.

In addition, the present disclosure further provides a method for controlling the dishwasher. Referring to FIG. 10 to FIG. 15, an exemplary embodiment of the method for controlling the dishwasher according to the present disclosure is shown in the drawings.

Figure 10:
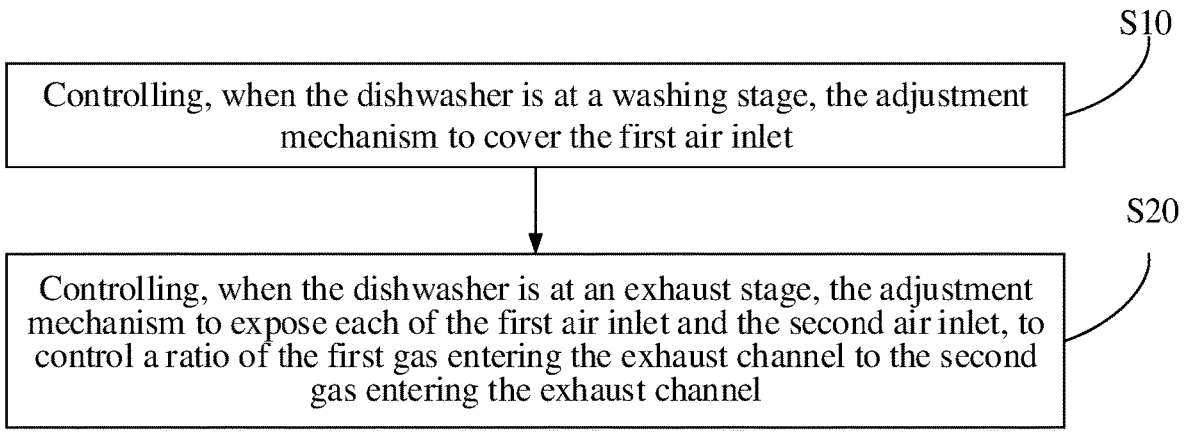
FIG. 10 is a schematic flowchart of a first embodiment of a method for controlling a dishwasher according to the present disclosure.

Referring to FIG. 10, a first embodiment of the method for controlling the dishwasher according to the present disclosure will be described below.

The dishwasher 1 includes a shell 10, a tub 20, and an exhaust system 30. The exhaust system 30 according to the present disclosure includes a housing 400 and an adjustment device 500. The housing 400 has an exhaust channel 410, a first air inlet 420, and a second air inlet 430. The first air inlet 420 and the second air inlet 430 are in communication with the exhaust channel 410, respectively. The first air inlet 420 is in communication with a tub 20 of the dishwasher 1 to introduce a first gas 901 discharged from the tub 20, and the second air inlet 430 is configured to introduce a second gas 902 with humidity lower than humidity of the first gas 901. The adjustment device 500 includes an adjustment mechanism 500 and a controller. The adjustment mechanism 500 is configured to, under control of the controller, respectively adjust a flow rate of the first gas 901 entering the exhaust channel 410 through the first air inlet 420 and a flow rate of the second gas 902 entering the exhaust channel 410 through the second air inlet 430, to control a ratio of the first gas 901 entering the exhaust channel 410 to the second gas 902 entering the exhaust channel 410.

It can be understood that the controller can realize intelligent operation of the adjustment mechanism based on the predetermined rules or actual needs. The adjustment mechanism adjusts the flow rate of the first gas 901 entering the exhaust channel 410 from the first air inlet 420 and/or the flow rate of the second gas 902 entering the exhaust channel 410 from the second air inlet 430, allowing for an adjustable ratio of the first gas 901 at the exhaust channel 410 to the second gas 902 at the exhaust channel 410. Therefore, it is possible to effectively lower the flow rate of the first gas 901 entering the exhaust channel 410 when a large amount of the first gas 901 is discharged from the tub 20, and introduce sufficient second gas 902 for the first gas 901 to realize rapid drying of the first gas 901. When a small amount of the first gas 901 is discharged from the tub 20, the flow rate of the first gas 901 entering the exhaust channel 410 is effectively increased, and drying efficiency of the first gas 901 is improved. In addition, the first air inlet 420 is in direct communication with the exhaust channel 410 to enable the first gas 901 discharged from the tub 20 to be directly dried, which prevents formation of a cooling medium at a path where the first gas 901 enters the exhaust channel and generation of condensate water. According to the technical solutions of the present disclosure, it is possible to effectively enhance the drying efficiency of the first gas 901 discharged from the tub 20. Moreover, the generation of condensate water can be reduced or even eliminated, and a drying effect is optimized.

In addition, it should be noted that the embodiments of the dishwasher 1 include all the technical solutions of all the embodiments of the exhaust system 30, and the achieved technical effects are also exactly same, and thus the description thereof in detail will be omitted herein for brevity.

Based on this, the method for controlling the dishwasher includes the following actions at blocks S10 and S20.

At block S10, when the dishwasher 1 is at a washing stage, the adjustment mechanism is controlled to cover the first air inlet 420.

In this embodiment, the controller may monitor, in various manners, whether the dishwasher 1 is at the washing stage. For example, it may be determined whether the dishwasher 1 is at the washing stage by determining whether a related instruction transmitted by a predetermined control system of the dishwasher 1 is received; or an operation state of the tub 20 may be sensed by additionally providing a sensing device. When the dishwasher 1 is at the washing stage, sufficient steam needs to be formed in the tub 20, to ensure the required washing effect. The first air inlet 420 is covered by controlling the adjustment mechanism to block the first gas 901 from entering the exhaust channel 410 through the first air inlet 420. That is, leakage of the first gas 901 in the tub 20 is avoided, and thus heat loss is lowered. Therefore, it is possible to prevent the condensate water from being condensed and generated at the exhaust channel 410.

At block S20, when the dishwasher 1 is at an exhaust stage, the adjustment mechanism is controlled to expose each of the first air inlet 420 and the second air inlet 430, to control a ratio of the first gas 901 entering the exhaust channel 410 to the second gas 902 entering the exhaust channel 410.

In some embodiments, when the dishwasher 1 is at the exhaust stage and there is a larger amount of the steam, the controller may control the adjustment mechanism to adjust an airflow area of the first air inlet 420 and an airflow area of the second air inlet 430 to adjust the first gas 901 and the second gas 902 to respectively enter the exhaust channel 410. Moreover, the ratio of the first gas 901 to the second gas 902 is within a suitable range. In this way, the first gas 901 has an enough exhaust amount, and the second gas 902 can quickly dry the first gas 901 to avoid the generation of the condensate water. When the dishwasher 1 is at the exhaust stage and the amount of the steam is reduced to a predetermined value, the controller can adjust the first air inlet 420 to be fully opened by controlling the adjustment mechanism, to allow the first gas 901 to enter the exhaust channel 410 at a maximum flow rate. Therefore, rapid discharge of the first gas 901 can be realized.

Figure 11:
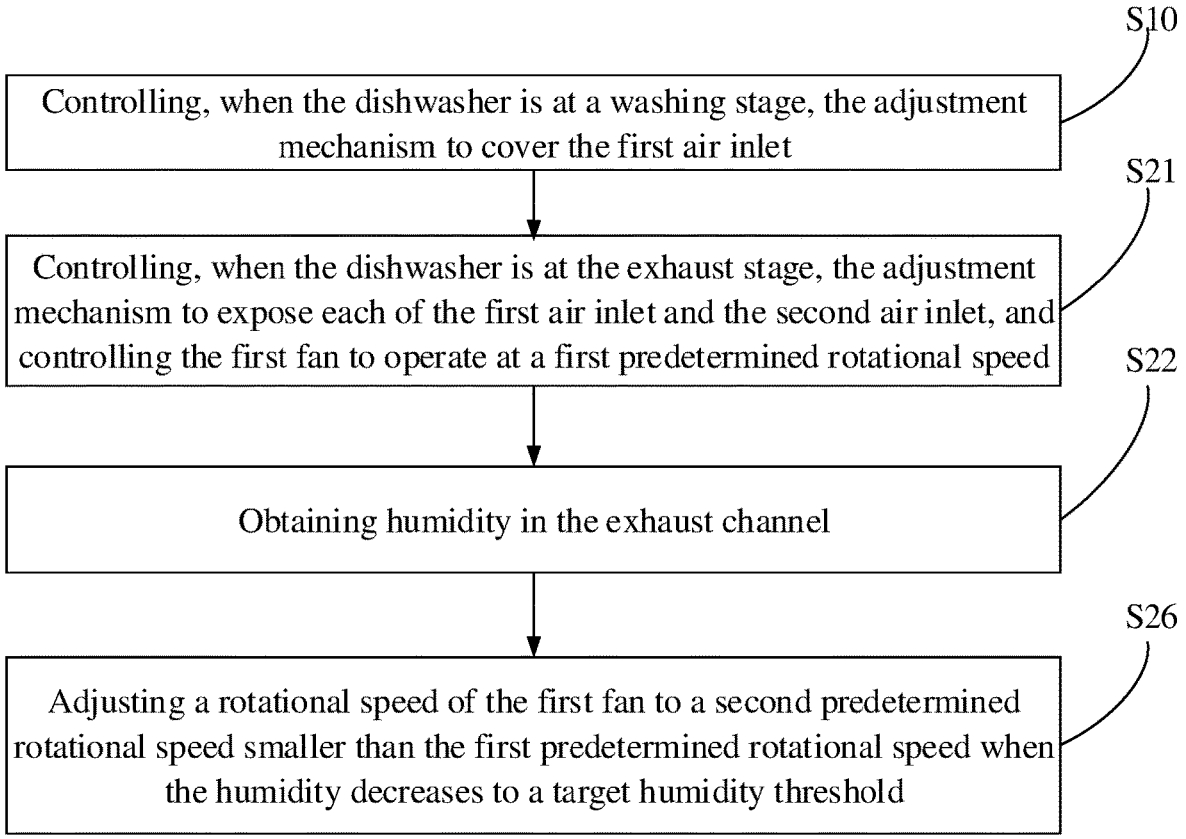
FIG. 11 is a schematic flowchart of a second embodiment of a method for controlling a dishwasher according to the present disclosure.

Referring to FIG. 11, a second embodiment of the method for controlling the dishwasher according to the present disclosure is provided.

As described above, the dishwasher 1 further includes a sensor 800 and a first fan 700 that are disposed in the exhaust channel 410. The sensor 800 includes a humidity sensing module.

When the first fan 700 is disposed in the exhaust channel 410 and is electrically connected to the controller, the sensor 800 may be arranged upstream or downstream of the first fan 700, i.e., may be disposed at a side away from an exhaust outlet 440 or at a side close to the exhaust outlet 440 as desired.

In this case, at block S20, when the dishwasher 1 is at an exhaust stage, the adjustment mechanism 500 is controlled to expose each of the first air inlet 420 and the second air inlet 430, to control a ratio of the first gas 901 entering the exhaust channel 410 to the second gas 902 entering the exhaust channel 410.

At block S21, when the dishwasher 1 is at the exhaust stage, the adjustment mechanism 500 is controlled to expose each of the first air inlet 420 and the second air inlet 430, and the first fan 700 is controlled to operate at a first predetermined rotational speed.

In this embodiment, as described above, the adjustment mechanism can allow the ratio of the first gas 901 in the exhaust channel 410 to the second gas 902 in the exhaust channel 410 to be adjusted to a suitable range by adjusting the airflow area of the first air inlet 420 and the airflow area of the second air inlet 430. Further, the first fan 700 may be controlled to be switched on and has a rotational speed reaching the first predetermined rotational speed. In this case, the gas in the exhaust channel 410 can be driven to circulate to form a large exhaust amount. Therefore, it is helpful to improve drying effect of the dishwasher 1.

At block S22, humidity in the exhaust channel 410 is obtained.

It can be understood that the humidity may be obtained through sensing of a humidity sensing module disposed in the exhaust channel 410. The humidity is humidity of gas at the exhaust channel 410, i.e., humidity of a mixed gas 903 obtained by mixing the first gas 901 and the second gas 902, which may visually reflect drying effect of the exhaust channel 410.

At block S26, a rotational speed of the first fan 700 is adjusted to a second predetermined rotational speed smaller than the first predetermined rotational speed when the humidity decreases to a target humidity threshold.

It can be understood that the humidity is a real-time measurement. The humidity gradually decreases with the continuous operation of the exhaust channel 410. When the humidity decreases to the target humidity threshold, it is indicated that the current drying effect of the dishwasher 1 reaches or approaches a target drying effect. At this time, an amount of the first gas 901 entering the exhaust channel 410 is small, and a required amount of the second gas 902 decreases. In this case, it is possible to adjust the rotational speed of the first fan 700 to be lowered, reduce an exhaust speed in the exhaust channel 410, and prolong a residence time of the second gas 902 in the exhaust channel 410. Therefore, it is possible to allow the first gas 901 in the exhaust channel 410 to be fully dried and save the energy loss.

It should be noted that each of the first predetermined rotational speed, the second predetermined rotational speed, and the target humidity threshold as described above may be determined as desired. For example, each of the first predetermined rotational speed, the second predetermined rotational speed, and the target humidity threshold may be determined by using factory default values or by user-defined settings.

Figure 12:
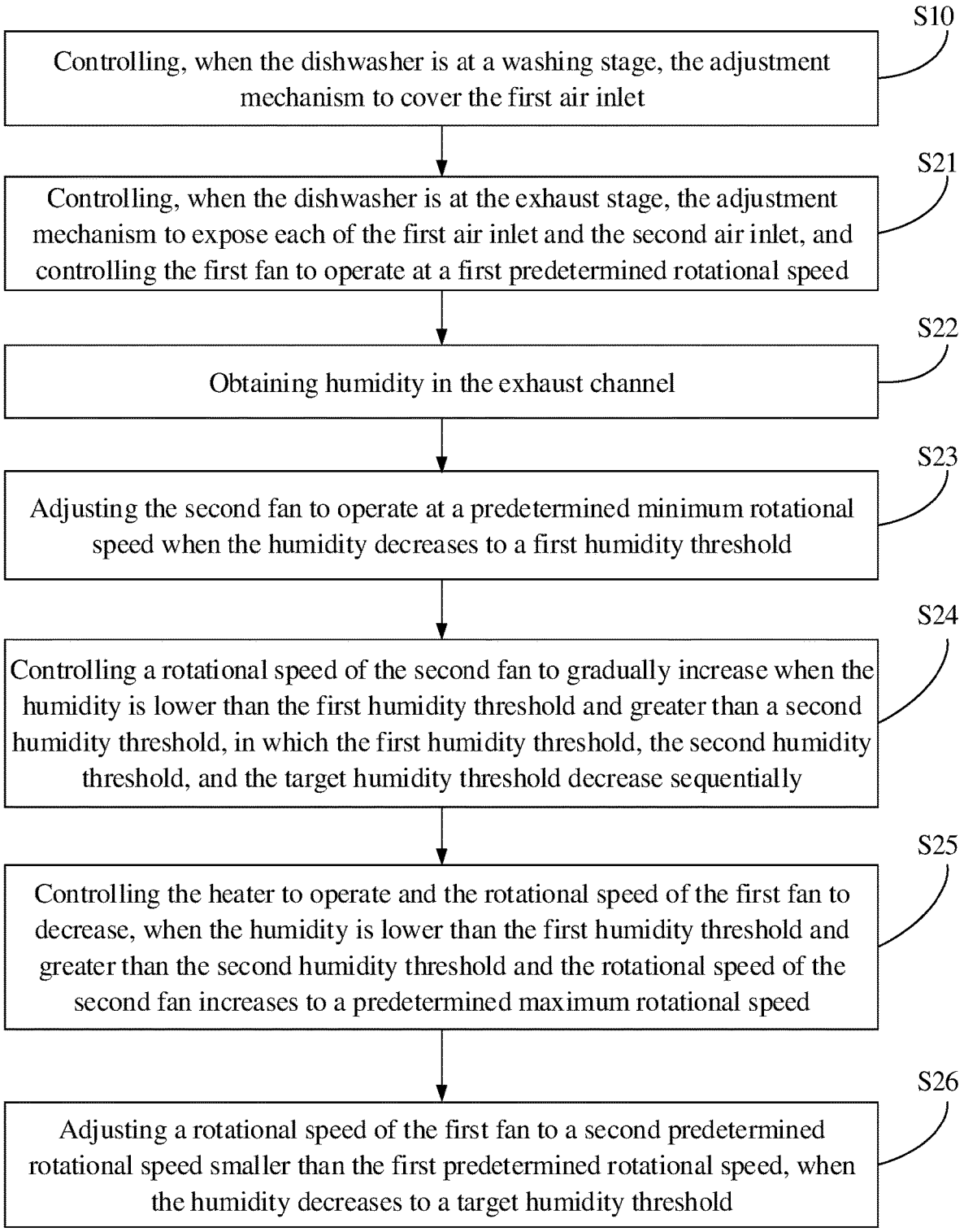
FIG. 12 is a schematic flowchart of a third embodiment of a method for controlling a dishwasher according to the present disclosure.

Referring to FIG. 12, a third embodiment of the method for controlling the dishwasher according to the present disclosure is provided.

As described above, the dishwasher 1 further includes a second fan and a heater that are disposed in a tub 20. The second fan is disposed in the tub 20 and is configured to drive the circulation of the gas in the tub 20 and drive a first gas 901 to enter an exhaust channel 410 more quickly. The second fan is electrically connected to a controller to be controlled by the controller to operate. The heater is disposed at the tub 20, and is capable of heating the gas in the tub 20 to form the required hot air. The heater is electrically connected to the controller to be controlled by the controller to operate.

The method further includes, prior to the action at block S26 of adjusting the rotational speed of the first fan 700 to the second predetermined rotational speed smaller than the first predetermined rotational speed when the humidity decreases to the target humidity threshold: the action at block S23 of adjusting the second fan to operate at a predetermined minimum rotational speed when the humidity decreases to a first humidity threshold.

In this embodiment, when the humidity decreases to the first humidity threshold, the second gas 902 in the exhaust channel 410 is more than the first gas 901. Therefore, the second fan at the tub 20 may be switched on first, and the first gas 901 in the tub 20 is quickly discharged into the exhaust channel 410 through the second fan and fully mixed with the second gas 902. At this time, a flow rate of the second gas 902 relatively decreases, and the second fan operates at the predetermined minimum rotational speed. Therefore, a flow speed of the first gas 901 is slowed down. Moreover, enough time is provided for the first gas 901 to be mixed with the second gas 902, which is helpful to reduce energy consumption of the second fan.

At block S24, a rotational speed of the second fan is controlled to gradually increase when the humidity is lower than the first humidity threshold and greater than a second humidity threshold. The first humidity threshold, the second humidity threshold, and the target humidity threshold decrease sequentially.

In this embodiment, when the humidity decreases from the first humidity threshold to be sufficiently close to the second humidity threshold, the second gas 902 in the exhaust channel 410 is more than the first gas 901. At this time, the rotational speed of the second fan may gradually increase, to allow more first gas 901 to enter the exhaust channel 410 to be mixed with the second gas 902. Therefore, drying capability of the second gas 902 is fully utilized, and rapid discharge of the first gas 901 in the tub 20 is facilitated.

At block S25, the heater is controlled to operate and the rotational speed of the first fan 700 is controlled to decrease, when the humidity is lower than the first humidity threshold and greater than the second humidity threshold and the rational speed of the second fan increases to a predetermined maximum rotational speed.

In this embodiment, when the rotational speed of the second fan reaches the maximum and the humidity at the second fan does not reach the second humidity threshold, the heater may be controlled to operate and cooperates with the second fan, which can directly dry the first gas 901 in the tub 20, to allow the first gas 901 entering the exhaust channel 410 from the tub 20 to be dried to some extent. At this time, by properly decreasing the rotational speed of the first fan 700, it is beneficial to prolong a residence time of the first gas 901 in the exhaust channel 410 and a residence time of the second gas 902 in the exhaust channel 410. Therefore, thorough drying of the first gas 901 is realized, and generation of the condensate water is completely eliminated. Moreover, it is possible to reduce energy consumption and save energy.

Figure 13:
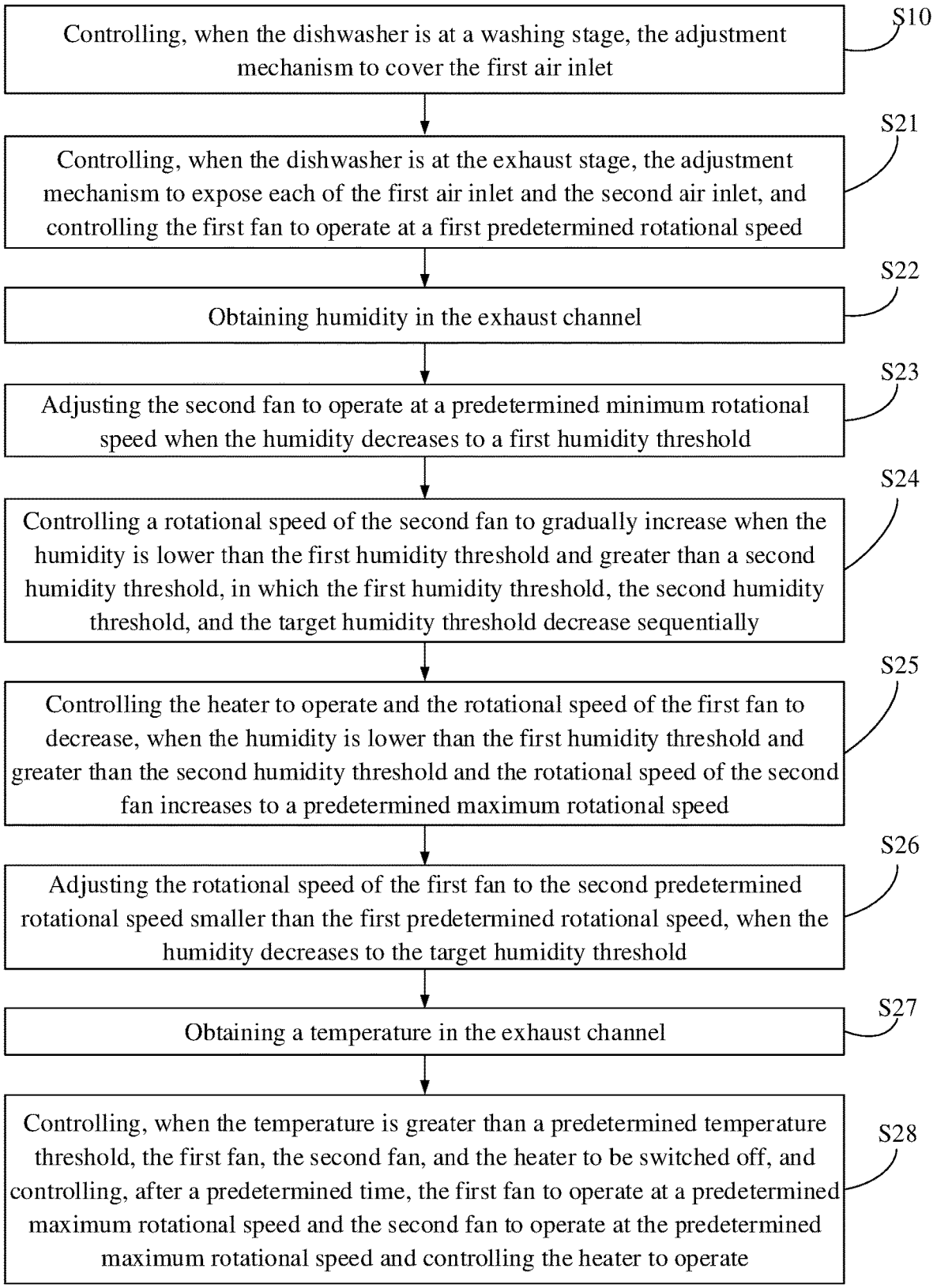
FIG. 13 is a schematic flowchart of a fourth embodiment of a method for controlling a dishwasher according to the present disclosure.

Referring to FIG. 13, a fourth embodiment of the method for controlling the dishwasher according to the present disclosure is provided.

Based on the above descriptions, the sensor 800 further includes a temperature sensing module. The sensor 800 is disposed in an exhaust channel 410, and the temperature sensing module is configured to sense a temperature at the exhaust channel 410. The method further includes, subsequent to the actions at block S26 of adjusting the rotational speed of the first fan 700 to the second predetermined rotational speed smaller than the first predetermined rotational speed when the humidity decreases to the target humidity threshold: actions at blocks S27 and block S28.

At block S27, a temperature of the exhaust channel 410 is obtained.

At block S28, when the temperature is greater than a predetermined temperature threshold, the first fan 700, the second fan, and the heater are controlled to be switched off; and after a predetermined time, the first fan 700 is controlled to operate at a predetermined maximum rotational speed, the second fan is controlled to operate at the predetermined maximum rotational speed, and the heater is controlled to operate.

It can be understood that the temperature sensing module can sense the temperature at the exhaust channel 410 in real time. When the temperature is greater than the predetermined temperature threshold, residual first gas 901 at the exhaust channel 410 is sufficiently dried with a current temperature in the exhaust channel 410. Therefore, the first fan 700, the second fan, and the heater may be controlled to be switched off in consideration of energy saving.

During the switching off of the first fan 700, the second fan, and the heater, the first gas 901 still enters the exhaust channel 410 at a predetermined flow rate, and thus the humidity at the exhaust channel 410 is gradually increased. Therefore, after the predetermined time, the first fan 700 may be controlled to operate at the predetermined maximum rotational speed, the second fan may be controlled to operate at the predetermined maximum rotational speed, and the heater may be controlled to operate, which can thoroughly dry the first gas 901 more quickly.

Figure 14:
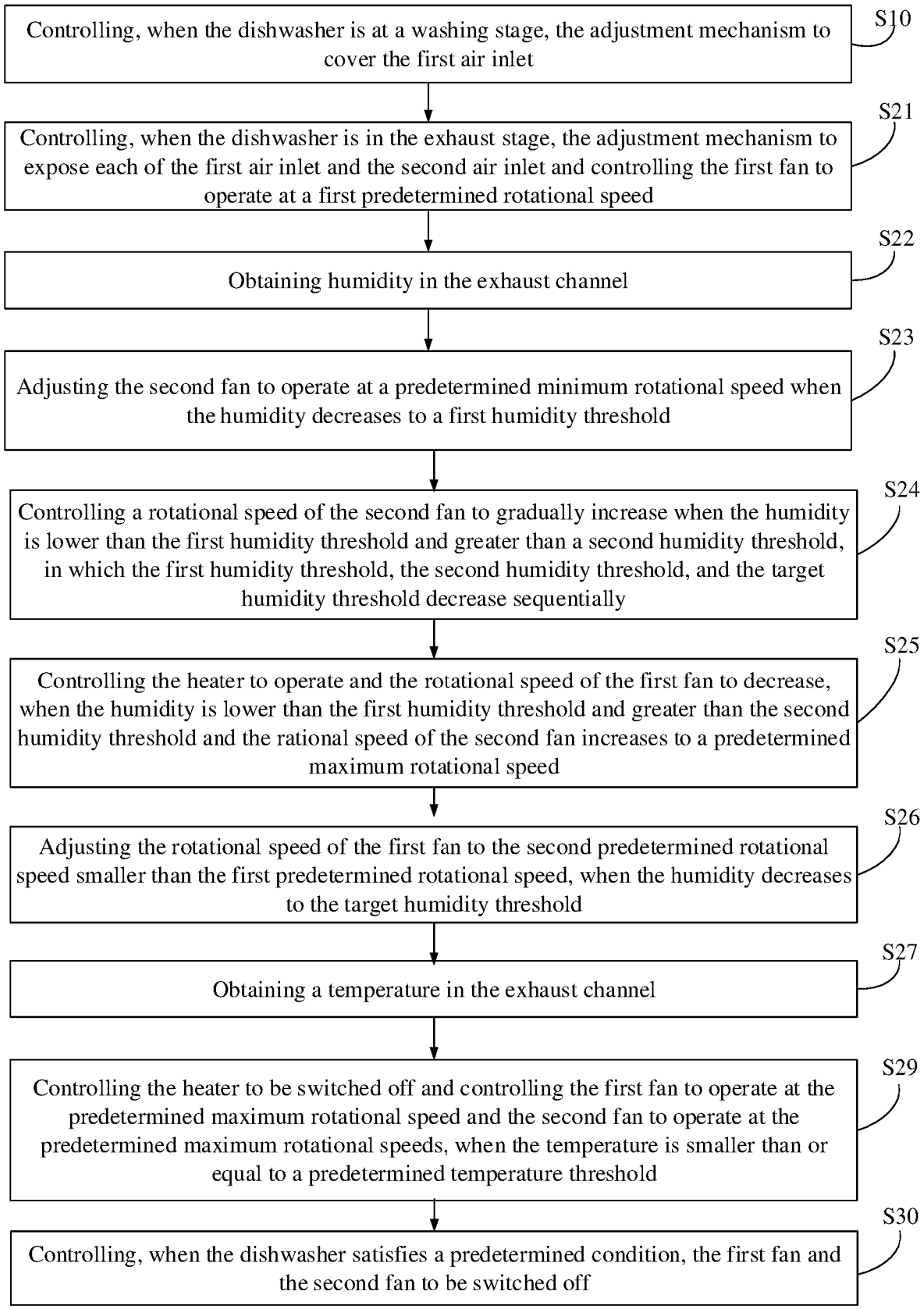
FIG. 14 is a schematic flowchart of a fifth embodiment of a method for controlling a dishwasher according to the present disclosure.

Referring to FIG. 14, provided is a fifth embodiment of the method for controlling the dishwasher according to the embodiments of the present disclosure.

The method for controlling the dishwasher further includes, subsequent to the actions at block S27 of obtaining the temperature of the exhaust channel 410: actions at blocks S29 and S30.

At block S29, the heater is controlled to be switched off, and the first fan 700 is controlled to operate at the predetermined maximum rotational speed and the second fan is controlled to operate at the predetermined maximum rotational speed, when the temperature is smaller than or equal to a predetermined temperature threshold.

At block S30, when the dishwasher 1 satisfies a predetermined condition, the first fan 700 and the second fan are controlled to be switched off.

In this embodiment, when the temperature is smaller than or equal to the predetermined temperature threshold, and the humidity has reached or is fully close to the target humidity, it is indicated that the drying effect in the exhaust channel 410 is close to a target drying requirement. Therefore, the heater may be controlled to be switched off, to achieve a purposes of energy conservation and consumption reduction. Moreover, the first fan 700 is controlled to operate at the predetermined maximum rotational speed and the second fan is controlled to operate at the predetermined maximum rotational speed, to thoroughly dry the first gas 901 more quickly.

After the dishwasher 1 has satisfied the predetermined condition, the first fan 700 and the second fan are controlled to be switched off. When the predetermined condition may be that when the first fan 700 operate for a predetermined duration and the second fan operate for a predetermined duration, or when it is determined that the humidity and the temperature both satisfy the predetermined threshold after continuing to sense the humidity and the temperature in the exhaust channel 410, which is not limited herein.

Figure 15:
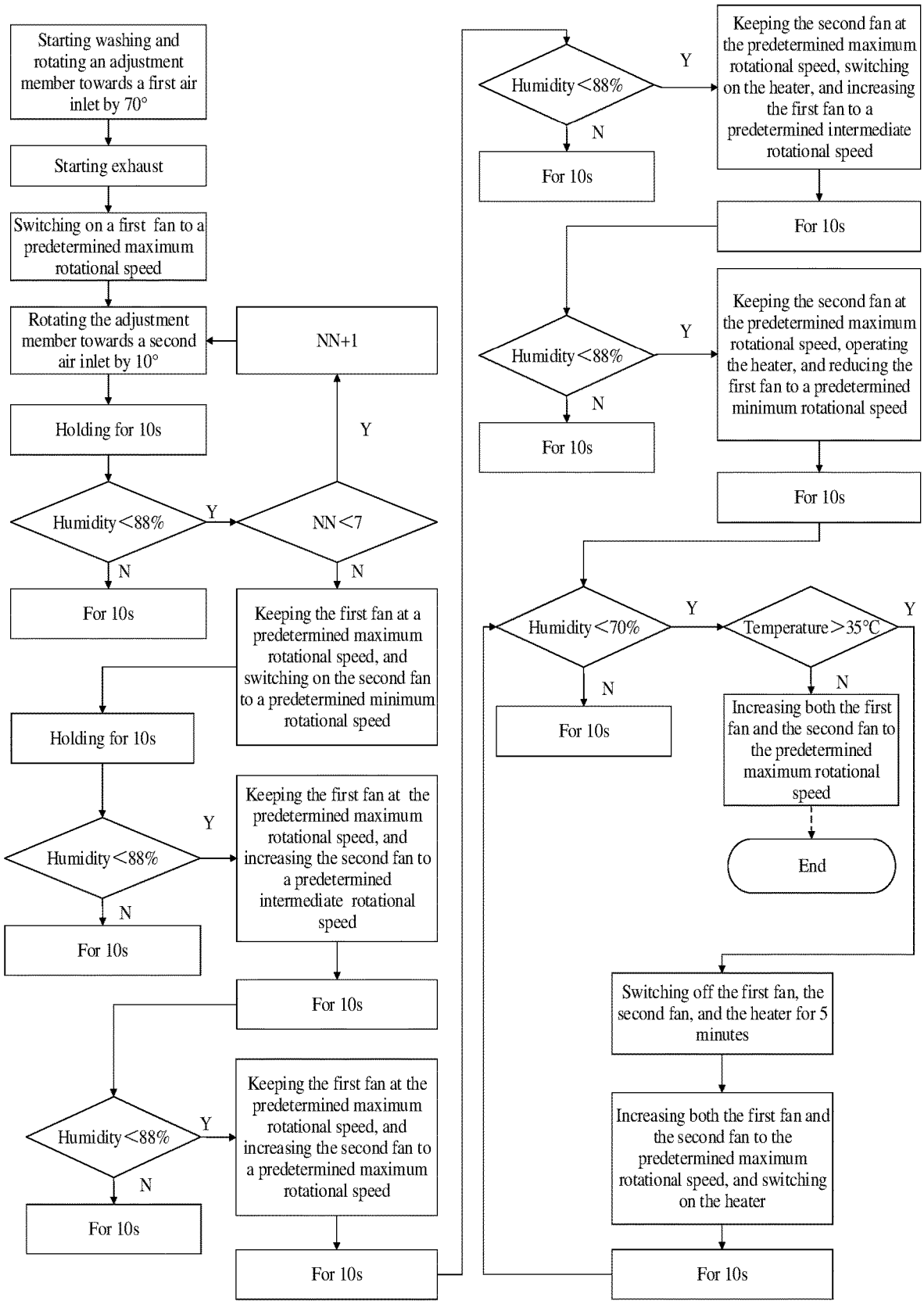
FIG. 15 is a schematic flowchart of a sixth embodiment of a method for controlling a dishwasher according to the present disclosure.

Referring to FIG. 15, in a sixth embodiment of the method for controlling the dishwasher according to the present disclosure, a first gas 901 discharged from a tub 20 may be dried with a maximum humidity and a reduced energy consumption.

In some embodiments, in combination with a structure of the dishwasher 1 illustrated in FIG. 1 to FIG. 9, the mounting end of the adjustment member 510 may be rotatably disposed along the rotation axis extending in the direction substantially parallel to the connection wall 450, to allow the plate surface of the adjustment member 510 to rotate relative to the plane where the connection wall 450 is located. The dishwasher 1 includes the first fan 700, the second fan, and the heater as described above.

A plane where the first air inlet 420 is located and a plane where the second air inlet 430 is located intersect with each other. That is, the first air inlet 420 and the second air inlet 430 are gradually inclined towards each other away from the exhaust channel 410.

Based on the above, when an angle between the plane where the second air inlet 430 is located and the plane where the first air inlet 420 is located is 70°, and the adjustment member 510 is designed to be in a state in which the second air inlet 430 is covered with the adjustment member 510 before the washing starts, when the washing starts, the adjustment member 510 is controlled to rotate towards the first air inlet 420 by 70°, to allow the first air inlet 420 to be fully covered with the adjustment member 510, which can avoids energy loss in the tub 20. Further, the second air inlet 430 is fully exposed.

When the washing stage is completed and the exhaust stage is performed, the first fan 700 is first controlled to be switched on at its predetermined maximum rotational speed, to ensure that the exhaust channel 410 is filled with enough second gas 902. Then, the adjustment member 510 is controlled to expose the first air inlet 420, to allow the first gas 901 discharged from the tub 20 to enter the exhaust channel 410 to be mixed with the second gas 902. At this time, the flow rate of the first gas 901 is significantly smaller than that of the second gas 902. Thus, the first gas 901 entering the exhaust channel 410 can be quickly dried by the second gas 902 to avoid the generation of the condensate water.

At this time, current humidity in the exhaust channel 410 may be sensed. When the humidity is lower than 88%, the adjustment member 510 is controlled to rotate gradually. For example, the first air inlet 420 is exposed gradually based on a rotation angle of 10°, enabling the flow rate of the first gas 901 to gradually increase and the flow rate of the second gas 902 to gradually decrease.

When the first air inlet 420 is fully exposed and the humidity is still lower than 88%, the rotational speed of the first fan 700 may be maintained to the predetermined maximum rotational speed thereof, and the second fan is switched on simultaneously. The second fan operates at the predetermined minimum rotational speed thereof. When the humidity is still lower than 88%, the rotational speed of the second fan is gradually increased to its predetermined intermediate rotational speed and its predetermined maximum rotational speed sequentially.

When the first fan 700 operate at the predetermined maximum rotational speed and the second fan operate at the predetermined maximum rotational speed, and the humidity is still lower than 88%, the heater may be switched on to operate. At this time, the heater can achieve a better drying effect by increasing a gas temperature. Therefore, the first fan 700 may be adjusted to the predetermined minimum rotational speed in consideration of energy conservation, enabling the first gas 901 and the second gas 902 to fully remain in the exhaust channel 410 and be mixed therein.

Then, when the humidity is lower than 70% and the temperature is greater than 35° C., the first fan 700, the second fan, and the heater may be controlled to be switched off for 5 minutes. For example, after the residual temperature continues to dry the first gas 901 for 5 minutes, the first fan 700 and the second fan may be controlled to operate at their predetermined maximum rotational speeds, and the heater is switched on to maintain the humidity to be lower than 70%.

Conversely, when the humidity is lower than 70%, and the temperature is smaller than or equal to 35° C., the first fan 700 may be controlled to operate at the predetermined maximum rotational speed, and the second fan may be controlled to operate at the predetermined maximum rotational speed, to allow the first fan 700 and the second fan to be switched off after fully drying.

It should be noted that, after each step in the foregoing process, the current state may be maintained for a period of time, and the specific time length is not limited, such as 10 seconds shown in the drawings. In addition, the predetermined minimum rotational speed, the predetermined intermediate rotational speed, and the predetermined maximum rotational speed of each of the first fan 700 and the second fan may be set to be the same as each other, or at least partially different from each other. The values involved in the above embodiments do not constitute a limitation on the operation parameters in an actual operating process of the dishwasher 1 and may be adjusted as desired.

It should be noted that, after the exhaust system 30 is applied in the dishwasher 1, the controller configured as the control unit may be integrated with the control system predetermined for the dishwasher 1. That is, the control system predetermined for the dishwasher 1 directly implements the at least part of the control functions of the controller; or, the controller constructed as the control unit may be separated from the control system predetermined for the dishwasher 1, to independently realize respective control functions. When the exhaust system 30 needs to perform signal transmission with the dishwasher 1, the controller may be electrically connected to the control system.

It can be understood that the controller may be, but is not limited to, a storage device, a processor, and a control program stored on the memory and executable on the processor. The control program of the dishwasher is configured to implement the steps of the method for controlling the dishwasher as described above.

In addition, the present disclosure further provides a storage medium storing a control program for a dishwasher thereon. The control program for the dishwasher, when executed by a processor, implements the steps of the method for controlling the dishwasher as described above. All storage devices, processors, and storage media capable of performing the functions described above may be applied in the present disclosure and are not limited herein. The storage medium is a computer storage medium, which for example may include an operating system, a network communication device, a user interface device, and the control program for the dishwasher, and the description thereof in detail will be omitted herein.

The above is only a preferred embodiment of the present disclosure and is not intended to limit the scope of the present disclosure. Any equivalent structural modification made by using the descriptions and drawings of the present disclosure, or direct/indirect application in other related technical fields within the concept of the present disclosure shall fall within the scope of the present disclosure.

What is claimed is:

1. An adjustment device, applied in an exhaust system of a dishwasher, wherein the exhaust system has an exhaust channel with a first air inlet in communication with a tub of the dishwasher and a second air inlet, the adjustment device comprising:

an adjustment mechanism; and a controller, wherein the adjustment mechanism comprises an adjustment member having a pivoting end and a swing end, wherein the adjustment member comprises three operational configurations, wherein in a first operational configuration, the adjustment member is pivoted, under the control of the controller, to be movably arranged to fully block the first air inlet, wherein in a second operational configuration, the adjustment member is pivoted, under the control of the controller, to be movably arranged to fully block the second air inlet, and wherein in a third operational configuration, the adjustment member is pivoted, under the control of the controller, to be movably arranged to partially block the first air inlet and the second air inlet to respectively adjust a flow rate of a first gas entering the exhaust channel through the first air inlet and a flow rate of a second gas entering the exhaust channel through the second air inlet, to control a ratio of the first gas entering the exhaust channel to the second gas entering the exhaust channel, and wherein humidity of the second gas is lower than humidity of the first gas.

2. The adjustment device according to claim 1, wherein:
the first air inlet comprises a steam inlet, and the second air inlet comprises an air inlet; and
the first gas comprises steam, and the second gas comprises air.

3. The adjustment device according to claim 2, wherein the adjustment mechanism comprises:
a drive component configured to drive the adjustment member to move between the air inlet and the steam inlet, to adjust a flow rate of steam entering the exhaust channel through the steam inlet and/or a flow rate of air entering the exhaust channel through the air inlet,
wherein the controller is electrically connected to the drive component, and configured to control a position of the adjustment member between the air inlet and the steam inlet to control a ratio of the steam entering the exhaust channel to the air entering the exhaust channel.

4. The adjustment device according to claim 3, wherein the drive component comprises a driver and a transmission mechanism connecting the driver and the adjustment member.

5. The adjustment device according to claim 3, wherein the adjustment member is constructed in a plate-like shape, and is configured for, driven by the drive component, reciprocating rotation between the steam inlet and the air inlet.

6. The adjustment device according to claim 5, wherein the adjustment member comprises:
a plate-shaped body movably arranged between the steam inlet and the air inlet; and
a mounting disc portion disposed at an end of the plate-shaped body, the mounting disc portion being rotatably connected to a side wall of the exhaust channel, and the drive component being connected to the mounting disc portion.

7. The adjustment device according to claim 5, wherein the drive component comprises:
a drive motor; and
two rotary portions arranged in parallel to each other and rotatably connected to the exhaust channel, wherein the two rotary portions are connected to the drive motor and the adjustment member in one-to-one correspondence, and the two rotary portions are provided with teeth at least on sides of the two rotary portions facing towards each other, the teeth being engaged with each other.

8. The adjustment device according to claim 7, wherein:
the adjustment member comprises:
a plate-shaped body movably arranged between the steam inlet and the air inlet; and
a mounting disc portion disposed at an end of the plate-shaped body, the mounting disc portion being rotatably connected to a side wall of the exhaust channel; and
the adjustment member is connected to a rotary portion coaxially mounted at the mounting disc portion and is restricted between the mounting disc portion and the side wall of the exhaust channel.

9. The adjustment device according to claim 8, wherein the mounting disc portion is at least partially hollowed-out.

10. The adjustment device according to claim 3, wherein:
the adjustment member has an abutment side facing towards the steam inlet, and is provided with an elastic seal layer and/or a protrusion at the abutment side, the protrusion being engaged with and fixed to the steam inlet; and/or
the adjustment member has an abutment side facing towards the air inlet, and is provided with an elastic seal layer and/or a protrusion at the abutment side, the protrusion being engaged with and fixed to the air inlet.

11. The adjustment device according to claim 3, further comprising a limit structure configured to limit the adjustment member at a housing of the exhaust channel when the adjustment member moves to cover the steam inlet and/or when the adjustment member moves to cover the air inlet.

12. The adjustment device according to claim 11, wherein:
the drive component comprises:
a drive motor; and
two rotary portions arranged in parallel to each other and rotatably connected to the exhaust channel, wherein the two rotary portions are connected to the drive motor and the adjustment member in one-to-one correspondence, and the two rotary portions are provided with teeth at least on sides of the two rotary portions facing towards each other, the teeth being engaged with each other; and
the limit structure is constructed by the teeth of the two rotary portions.

13. The adjustment device according to claim 3, wherein the adjustment member is provided with a guide portion, the guide portion being movably connected to an engagement portion disposed at the exhaust channel, to guide the adjustment member to move between the steam inlet and the air inlet.

14. The adjustment device according to claim 13, wherein the guide portion is constructed as a slid protrusion slidably connected to the engagement portion constructed as a slid groove.

15. The adjustment device according to claim 3, further comprising a position sensor electrically connected to the controller to sense position information of the adjustment member and/or a sensor electrically connected to the controller,
wherein the sensor comprises a temperature sensing module and a humidity sensing module, and is configured to sense a temperature and humidity at the exhaust channel, respectively.

16. An exhaust system comprising:
a housing having an exhaust channel, and a steam inlet and an air inlet that are in communication with the exhaust channel, the steam inlet being configured to be in communication with a tub of a dishwasher, and the air inlet being configured to introduce external air; and
the adjustment device according to claim 1.

17. A dishwasher comprising:
a shell;
a tub disposed in the shell; and
the exhaust system according to claim 16, the exhaust system being mounted at the shell.

18. A method for controlling a dishwasher, wherein the dishwasher comprises:
a shell;
a tub; and
an adjustment mechanism comprising an adjustment member having a pivoting end and a swinging end,
wherein the shell comprises an exhaust channel, and a first air inlet and a second air inlet that are in communication with the exhaust channel,
wherein the first air inlet being configured to introduce a first gas discharged from the tub, and the second air inlet being configured to introduce a second gas with humidity lower than humidity of the first gas, the method comprising:

controlling the adjustment member to pivot to fully block the first air inlet;

controlling the adjustment member to pivot to fully block the second air inlet; and controlling the adjustment member to pivot to partially block the first air inlet and the second air inlet to respectively adjust a flow rate of the first gas entering the exhaust channel through the first air inlet and a flow rate of the second gas entering the exhaust channel through the second air inlet to control a ratio of the first gas entering the exhaust channel to the second gas entering the exhaust channel, wherein controlling the adjustment member comprises:

controlling, when the dishwasher is at a washing stage, the adjustment member to cover the first air inlet to decrease the flow rate of the first gas entering the exhaust channel; and controlling, when the dishwasher is at an exhaust stage, the adjustment member to expose each of the first air inlet and the second air inlet, to control the ratio of the first gas entering the exhaust channel to the second gas entering the exhaust channel.

19. The method for controlling the dishwasher according to claim 18, wherein:

the dishwasher further comprises a sensor and a first fan that are disposed at the exhaust channel, the sensor comprising a humidity sensing module; and the controlling, when the dishwasher is at the exhaust stage, the adjustment member to expose each of the first air inlet and the second air inlet, to control the ratio of the first gas entering the exhaust channel to the second gas entering the exhaust channel comprises:

controlling, when the dishwasher is at the exhaust stage, the adjustment member to expose each of the first air inlet and the second air inlet, and controlling the first fan to operate at a first predetermined rotational speed;

obtaining humidity in the exhaust channel; and adjusting a rotational speed of the first fan to a second predetermined rotational speed smaller than the first predetermined rotational speed, when the humidity decreases to a target humidity threshold.

20. The method for controlling the dishwasher according to claim 19, wherein:

the dishwasher further comprises a second fan and a heater that are disposed at the tub; and the method further comprises, prior to said adjusting the rotational speed of the first fan to the second predetermined rotational speed smaller than the first predetermined rotational speed when the humidity decreases to the target humidity threshold:

adjusting the second fan to operate at a predetermined minimum rotational speed when the humidity decreases to a first humidity threshold;

controlling a rotational speed of the second fan to gradually increase when the humidity is lower than the first humidity threshold and greater than a second humidity threshold, the first humidity threshold, the second humidity threshold, and the target humidity threshold decreasing sequentially; and controlling the heater to operate and the rotational speed of the first fan to decrease when the humidity is lower than the first humidity threshold and greater than the second humidity threshold and the rotational speed of the second fan increases to a predetermined maximum rotational speed.

21. The method for controlling the dishwasher according to claim 20, wherein:

the sensor further comprises a temperature sensing module; and the method further comprises, subsequent to said adjusting the rotational speed of the first fan to the second predetermined rotational speed smaller than the first predetermined rotational speed when the humidity decreases to the target humidity threshold:

obtaining a temperature in the exhaust channel; and controlling, when the temperature is greater than a predetermined temperature threshold, the first fan, the second fan, and the heater to be switched off, and controlling, after a predetermined time, the first fan to operate at a predetermined maximum rotational speed and the second fan to operate at the predetermined maximum rotational speed and controlling the heater to operate.

22. The method for controlling the dishwasher according to claim 21, further comprising, subsequent to said obtaining the temperature of the exhaust channel:

controlling the heater to be switched off and controlling the first fan to operate at the predetermined maximum rotational speed and the second fan to operate at the predetermined maximum rotational speed, when the temperature is smaller than or equal to a predetermined temperature threshold; and controlling, when the dishwasher satisfies a predetermined condition, the first fan and the second fan to be switched off.

* * * * *